US011015419B2

(12) United States Patent
Foster et al.

(10) Patent No.: US 11,015,419 B2
(45) Date of Patent: May 25, 2021

(54) BYPASS DEVICES FOR A SUBTERRANEAN WELLBORE

(71) Applicant: BP Corporation North America Inc., Houston, TX (US)

(72) Inventors: Michael J. Foster, Katy, TX (US); Kevin Whaley, Houston, TX (US); Patrick Keatinge, Berkshire (GB)

(73) Assignee: BP Corporation North America Inc., Houston, TX (US)

( * ) Notice: Subject to any disclaimer, the term of this patent is extended or adjusted under 35 U.S.C. 154(b) by 188 days.

(21) Appl. No.: 16/408,619

(22) Filed: May 10, 2019

(65) Prior Publication Data

US 2019/0345799 A1 Nov. 14, 2019

Related U.S. Application Data

(60) Provisional application No. 62/671,250, filed on May 14, 2018.

(51) Int. Cl.

| | |
|---|---|
| ***E21B 43/04*** | (2006.01) |
| ***E21B 43/08*** | (2006.01) |
| ***E21B 43/12*** | (2006.01) |
| *E21B 34/14* | (2006.01) |

(52) U.S. Cl.

CPC ..... *E21B 43/04* (2013.01); *E21B 43/08* (2013.01); *E21B 43/121* (2013.01); *E21B 34/14* (2013.01)

(58) Field of Classification Search

CPC ..... E21B 43/121; E21B 43/08; E21B 34/14; E21B 43/04; E21B 43/045

See application file for complete search history.

(56) References Cited

U.S. PATENT DOCUMENTS

| | | | | |
|---|---|---|---|---|
| 7,207,383 | B2 | 4/2007 | Hurst et al. | |
| 8,371,386 | B2 * | 2/2013 | Malone | E21B 34/14 166/373 |
| 9,309,751 | B2 * | 4/2016 | Hall | E21B 17/18 |
| 10,145,219 | B2 * | 12/2018 | Bourgneuf | E21B 33/127 |
| 2007/0131421 | A1 | 6/2007 | Hurst et al. | |
| 2013/0277053 | A1 | 10/2013 | Yeh et al. | |
| 2014/0008066 | A1 | 1/2014 | Least | |
| 2014/0110132 | A1 | 4/2014 | Cunningham | |

(Continued)

FOREIGN PATENT DOCUMENTS

| | | | |
|---|---|---|---|
| WO | 20130187878 | A1 | 12/2013 |
| WO | 20170155546 | A1 | 9/2017 |

OTHER PUBLICATIONS

Partial International Search Report dated Aug. 1, 2019, for PCT/US2019/031682, filed on May 10, 2019.

(Continued)

*Primary Examiner* — Michael R Wills, III
(74) *Attorney, Agent, or Firm* — Conley Rose, P.C.

(57) ABSTRACT

Bypass devices are disclosed for providing alternative flow paths within an annulus formed around a production string of a subterranean wellbore. In some embodiments, the bypass devices include inlet flow paths and outlet flow paths in fluid communication with the annulus so that fluids may flow through the inlet and outlet flow paths to bypass a blockage in the annulus. The bypass devices are also configured to avoid internal blockages within the internal flow paths defined by the inlet flow paths and outlet flow paths.

17 Claims, 12 Drawing Sheets

(56) References Cited

U.S. PATENT DOCUMENTS

| | | | | |
|---|---|---|---|---|
| 2014/0262260 | A1 | 9/2014 | Mayer | |
| 2015/0337622 | A1* | 11/2015 | Lopez | E21B 43/08 166/66.6 |
| 2017/0204708 | A1* | 7/2017 | Duphorne | E21B 43/08 |
| 2018/0347311 | A1* | 12/2018 | Coffin | E21B 33/12 |
| 2019/0309605 | A1* | 10/2019 | Greci | E21B 43/04 |

OTHER PUBLICATIONS

International Search Report and Written Opinion dated Sep. 18, 2019, for PCT/US2019/031682, filed on May 10, 2019.

* cited by examiner

BYPASS DEVICES FOR A SUBTERRANEAN WELLBORE

CROSS-REFERENCE TO RELATED APPLICATIONS

This application claims benefit of U.S. provisional patent application Ser. No. 62/671,250 filed May 14, 2018, and entitled "Bypass Devices For A Subterranean Wellbore," which is hereby incorporated herein by reference in its entirety.

STATEMENT REGARDING FEDERALLY SPONSORED RESEARCH OR DEVELOPMENT

Not applicable.

BACKGROUND

This disclosure relates to systems for completing a subterranean wellbore. More particularly, this disclosure relates to systems for injecting gravel into a subterranean wellbore during open hole completion operations.

To obtain hydrocarbons from subterranean formations, wellbores are drilled from the surface to access the hydrocarbon-bearing formation (which may also be referred to herein as a producing zone). After drilling a wellbore to the desired depth, a completion string containing various completion and production devices is installed in the wellbore to produce the hydrocarbons from the producing zone to the surface. In some instances, no casing or liner is installed within the section of the wellbore extending within the producing zone. To prevent the free migration of sands or other fines from the producing zone into the completion and production devices (that is, along with any produced hydrocarbons), a fluid flow restriction device, usually including one or more screens, is placed within the un-cased section of the wellbore, and proppant (which is generally referred to herein as "gravel") is injected in a slurry and deposited into the annular space between the wellbore wall and the screens. Accordingly, the gravel forms a barrier to filter out the fines and sand from any produced fluids such that the fines and/or sand are prevented from entering the screens and being produced to the surface. This type of completion configuration is often referred to as an "open hole" completion or more specifically an "open hole gravel pack completion."

BRIEF SUMMARY

Some embodiments disclosed herein include a production system for a subterranean wellbore. In an embodiment, the production system includes a production string disposed within the wellbore. The production string has a central axis and includes an axially extending internal throughbore. In addition, the production system includes a plurality of screens disposed along the production string. An annulus is formed between the production string and the wellbore that is in fluid communication with the internal throughbore via the plurality of screens. Further, the production system includes a bypass device coupled to the production string. The bypass device includes an inlet assembly and a shunt tube coupled to the inlet assembly. The shunt tube is in fluid communication with the annulus. The inlet assembly includes a plurality of inlet flow paths extending helically about the central axis from an uphole end of the inlet assembly. The inlet flow paths are fluidly coupled to the annulus and extend at least 3600 about the central axis. In addition, the inlet assembly includes an outlet flow path extending to a downhole end of the inlet assembly. The outlet flow path is fluidly coupled to the shunt tube and the plurality of inlet flow paths.

In another embodiment, the production system includes a production string disposed within the wellbore. The production string has a central axis and includes an axially extending internal throughbore. In addition, the production system includes a plurality of screens disposed along the production string. An annulus is formed between the production string and the wellbore that is in fluid communication with the internal throughbore via the plurality of screens. Further, the production system includes a bypass device coupled to the production string. The bypass device includes an inlet assembly and a shunt tube coupled to the inlet assembly. The shunt tube is in fluid communication with the annulus. The inlet assembly includes a first body member disposed about the production string, and a second body disposed about the production string. The second body member is downhole of and axially spaced from the first body member. In addition, the inlet assembly includes at least one inlet flow path within the first body member that is fluidly coupled to the annulus. Further, the inlet assembly includes a manifold axially disposed between the first body member and the second body member and fluidly coupled to the at least one inlet flow path. Further, the inlet assembly includes an outlet flow path fluidly coupled to the shunt tube and the manifold.

In another embodiment, the production system includes a production string disposed within the wellbore. The production string has a central axis and includes an axially extending internal throughbore. In addition, the production system includes a plurality of screens disposed along the production string. An annulus is formed between the production string and the wellbore that is in fluid communication with the internal throughbore via the plurality of screens. Further, the production system includes a bypass device coupled to the production string. The bypass device includes an inlet assembly and a shunt tube coupled to the inlet assembly. The shunt tube is in fluid communication with the annulus. The inlet assembly includes a first body member disposed about the production string, and a second body disposed about the production string. The second body member is downhole of and axially spaced from the first body member. In addition, the inlet assembly includes an inlet flow path within the second body member that is fluidly coupled to the annulus. Further, the inlet assembly includes an outlet flow path within the second body member that is fluid coupled to the annulus and the shunt tube. Still further, the inlet assembly includes a manifold fluidly axially disposed between the first body member and the second body member and fluidly coupled to the inlet flow path and the outlet flow path.

Embodiments described herein comprise a combination of features and characteristics intended to address various shortcomings associated with certain prior devices, systems, and methods. The foregoing has outlined rather broadly the features and technical characteristics of the disclosed embodiments in order that the detailed description that follows may be better understood. The various characteristics and features described above, as well as others, will be readily apparent to those skilled in the art upon reading the following detailed description, and by referring to the accompanying drawings. It should be appreciated that the conception and the specific embodiments disclosed may be readily utilized as a basis for modifying or designing other structures for carrying out the same purposes as the disclosed embodiments. It should also be realized that such equivalent constructions do not depart from the spirit and scope of the principles disclosed herein.

BRIEF DESCRIPTION OF THE DRAWINGS

For a detailed description of various embodiments, reference will now be made to the accompanying drawings in which.

DETAILED DESCRIPTION

Figure 1:
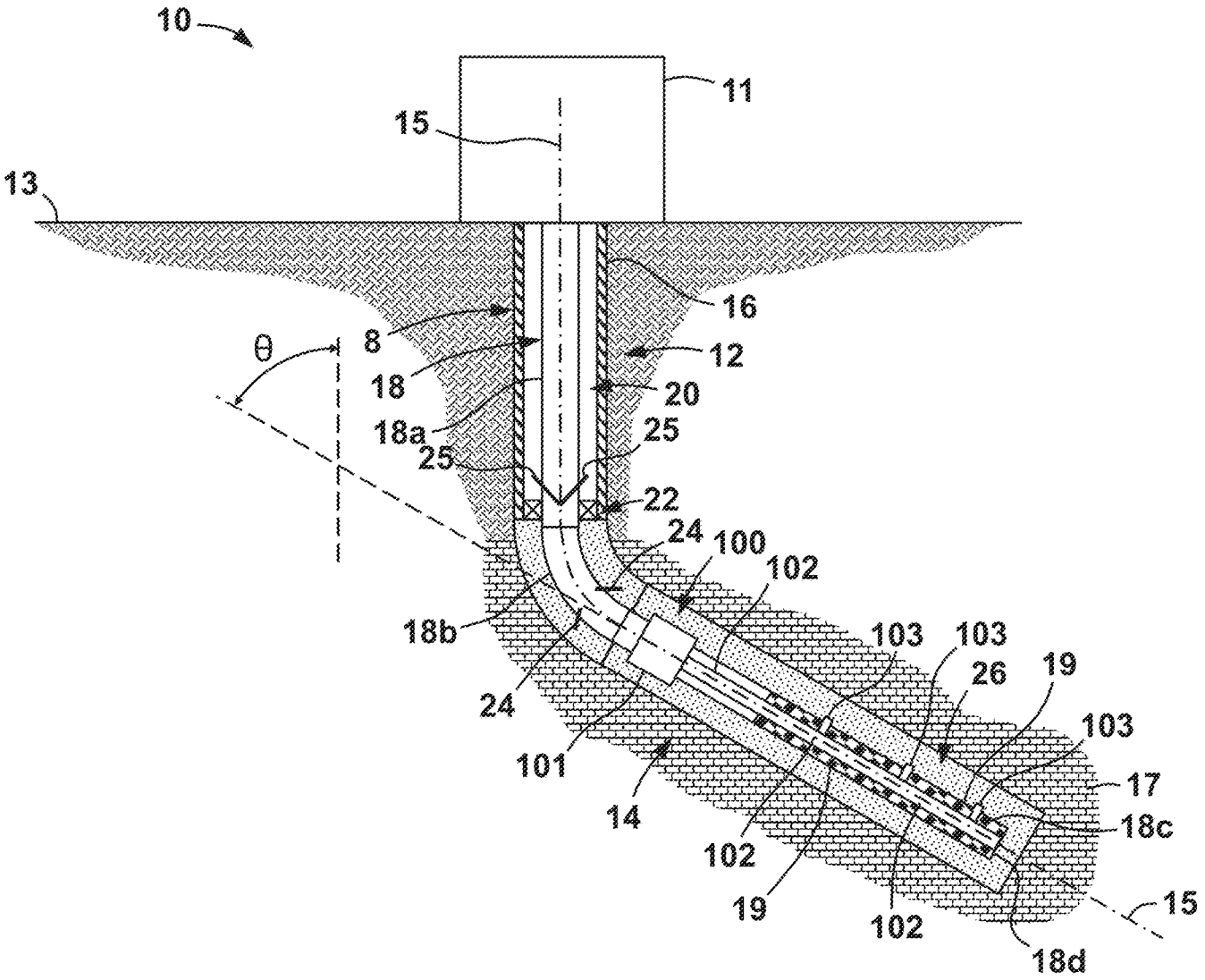
FIG. 1 is a schematic view of a system for producing hydrocarbon fluids from a subterranean wellbore in accordance with at least some embodiments disclosed herein.

The following discussion is directed to various exemplary embodiments. However, one of ordinary skill in the art will understand that the examples disclosed herein have broad application, and that the discussion of any embodiment is meant only to be exemplary of that embodiment, and not intended to suggest that the scope of the disclosure, including the claims, is limited to that embodiment.

The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection of the two devices, or through an indirect connection that is established via other devices, components, nodes, and connections. In addition, as used herein, the terms "axial" and "axially" generally mean along or parallel to a given axis (e.g., central axis of a body or a port), while the terms "radial" and "radially" generally mean perpendicular to the given axis. For instance, an axial distance refers to a distance measured along or parallel to the axis, and a radial distance means a distance measured perpendicular to the axis. Further, as used herein, the terms "circumferentially spaced" and "circumferential spacing" refer to the spacing about the circumferential or angular direction of a central axis. As a result, the term "uniformly circumferentially spaced" refers to equal or substantially equal spacing of the object or feature in question about a central axis (e.g., four objects placed every 900 about a central axis, three objects every 120° about a central axis, etc.). As used herein, the terms substantial, substantially, generally, about, approximately, and the like mean+/−10%. Finally, any reference to up or down in the description and the claims is made for purposes of clarity, with "up", "upper", "upwardly", "uphole", or "upstream" meaning toward the surface of the wellbore or borehole and with "down", "lower", "downwardly", "downhole", or "downstream" meaning toward the terminal end of the wellbore or borehole, regardless of the wellbore or borehole orientation.

Referring now to FIG. 1, a system 10 for producing hydrocarbon fluids from a subterranean wellbore 8 extending from the surface 13 along a central or longitudinal axis 15 is shown. In this embodiment, wellbore 8 includes a first or vertical section 12 that extends substantially vertically from the surface 13, and a second or lateral section 14 that extends from the downhole end of vertical section 12. In this embodiment, lateral section 14 (or a major portion of section 14) is disposed within a hydrocarbon-bearing formation 17 (which is also referred to herein as producing zone 17). In addition, as shown in FIG. 1, lateral section 14 extends from the downhole end of vertical section 12 at a non-zero angle θ relative to the vertical direction (i.e., the direction of the force of gravity). In some embodiments the angle θ may range from about 50 to about 90°, and in still other embodiments, the angle θ may range from about 60° to about 75°. However, other values of θ are contemplated, even if not specifically stated herein. It should be appreciated that in some embodiments, the wellbore 8 may only comprise vertical section 12 (such that there is no lateral section 14).

A casing or liner pipe 16 (or more simply "casing 16") is installed (e.g., cemented) within vertical section 12 such that fluid communication between surface 13 and wellbore 8 between the walls of vertical section 12 and casing 16 is prevented. A tubular completion or production string 18 extends within wellbore 8 through vertical section 12 and lateral section 14 and includes a first or upper section **18*a* extending from a surface structure 11 at surface 13 (which may comprise any suitable structure or equipment for drilling, servicing, or producing a subterranean wellbore), through casing 16 to a cross-over section 18*b*, and a lower section 18*c* extending from cross-over section 18*b* through lateral section 16 to a lower terminal end 18*d*. Lower section 18*c* includes one or more screens 19 that allow the passage of fluids into a central bore of lower section 18*c* (the central bore of lower section 18*c* is not specifically shown in FIG. 1) from lower annulus 26**.

A first or upper annulus or annular region 20 is formed radially between upper section **18*a* and the inner surface of casing pipe 16. A second or lower annulus or annular region 26 is formed radially between lower section 18*c* and the inner wall of lateral section 14 of wellbore 8. A lower sealing assembly 22 is disposed at the downhole end of casing 16 that seals or closes off upper annulus 20 from lower annulus 26. As a result, fluid is prevented from flowing or migrating directly between upper annulus 20 and lower annulus 26**.

Cross-over section 18*b* includes one or more flow paths 24 that are configured to route fluids pumped or flowed down the central bore of upper section 18*a* into the lower annulus 26, and one or more flow paths 25 that are configured to route fluids pumped or flowed up through the central bore of lower section 18*c* into upper annulus 20. The specific design and arrangement of cross-over section 18*b* (including flow paths 24, 25) are not described in detail herein; however, one having ordinary skill would understand how such a device would operate to allow the fluid flow paths described above. In particular, in some embodiments, cross-over section 18*b* may comprise one or more connected (e.g., threadably connected) subs or members that define flow paths 24, 25.

During an open hole gravel pack completion operation, a slurry comprising a carrier fluid and gravel is pumped from surface structure 11 through the central bore of upper section 18*a* and then into lower annulus 26 via flow paths 24 in cross-over section 18*b*. The slurry flows through lower annulus 26 such that the gravel is deposited into annulus 26 and the carrier fluid is routed back into a central bore of lower production section 18*c* through the one or more screens 19. The carrier fluid is finally flowed back uphole to the upper annulus 20 (and ultimately surface 13) via flow paths 25 in cross-over section 18*b*. As a result, screens 19 of lower section 18*c* may be sized so as to prevent the passage of the gravel therethrough.

It is imperative that gravel is deposited throughout the entire lower annulus 26 as uniformly as possible, since any gaps or holes in the gravel pack will provide a flow path for sand and fines of producing zone 17 to enter lower section 18*c* (via screens 19) and then up to surface 13, which is undesirable for the reasons previously described above. However, during an open hole completion operation, such as described above, gravel can accumulate at points within lower annulus 26 such that bridges or blockages are created that prevent further downhole progress of slurry thereafter. Such a failure can cause entire portions or sections of lower annulus 26 to be substantially devoid of gravel, so that production from these un-completed sections of wellbore 8 may ultimately need to be abandoned.

To mitigate the effects of blockages formed within lower annulus 26 during completion operations and therefore prevent these losses of production from wellbore 8, production string 18 further includes a bypass device 100 that provides alternative flow paths for slurry within lower annulus 26. As a result, bypass device 100 allows the slurry to effectively bypass (or flow around) any gravel bridges or other blockages within annulus 26 such that a more uniform gravel pack can be achieved in lower annulus 26 during completion operations. In this embodiment, bypass device 100 are disposed about lower section 18*c* of production string 18, uphole of screens 19.

As is generally shown in FIG. 1, bypass device 100 includes an inlet assembly 101 and one or more shunt tubes 102 extending axially downhole from inlet assembly 101 toward lower terminal end 18*d*. Shunt tubes 102 (only one tube 102 is shown in FIG. 1 for convenience) includes a plurality of axially spaced outlets 103 that are in communication with lower annulus 26.

While not specifically shown, outlets 103 may comprise one or more nozzles or other suitable communication devices for flowing fluids from between outlets 103 and lower annulus 26 during operations. Thus, inlet assembly 101 defines internal alternative flow paths that allow slurry to flow from lower annulus 26 into shunt tubes 102. Thereafter, the slurry returns to lower annulus 26 at a lower (or more downhole) position by exiting shunt tubes 102 either at a terminal downhole end of shunt tubes 102 and/or at one or more of the outlets 103. As a result, any bridges or blockages within annulus 26 disposed axially between inlet assembly 101 and the outlets 103 or end of shunt tubes 102 may be bypassed by the slurry during operations.

Figure 2:
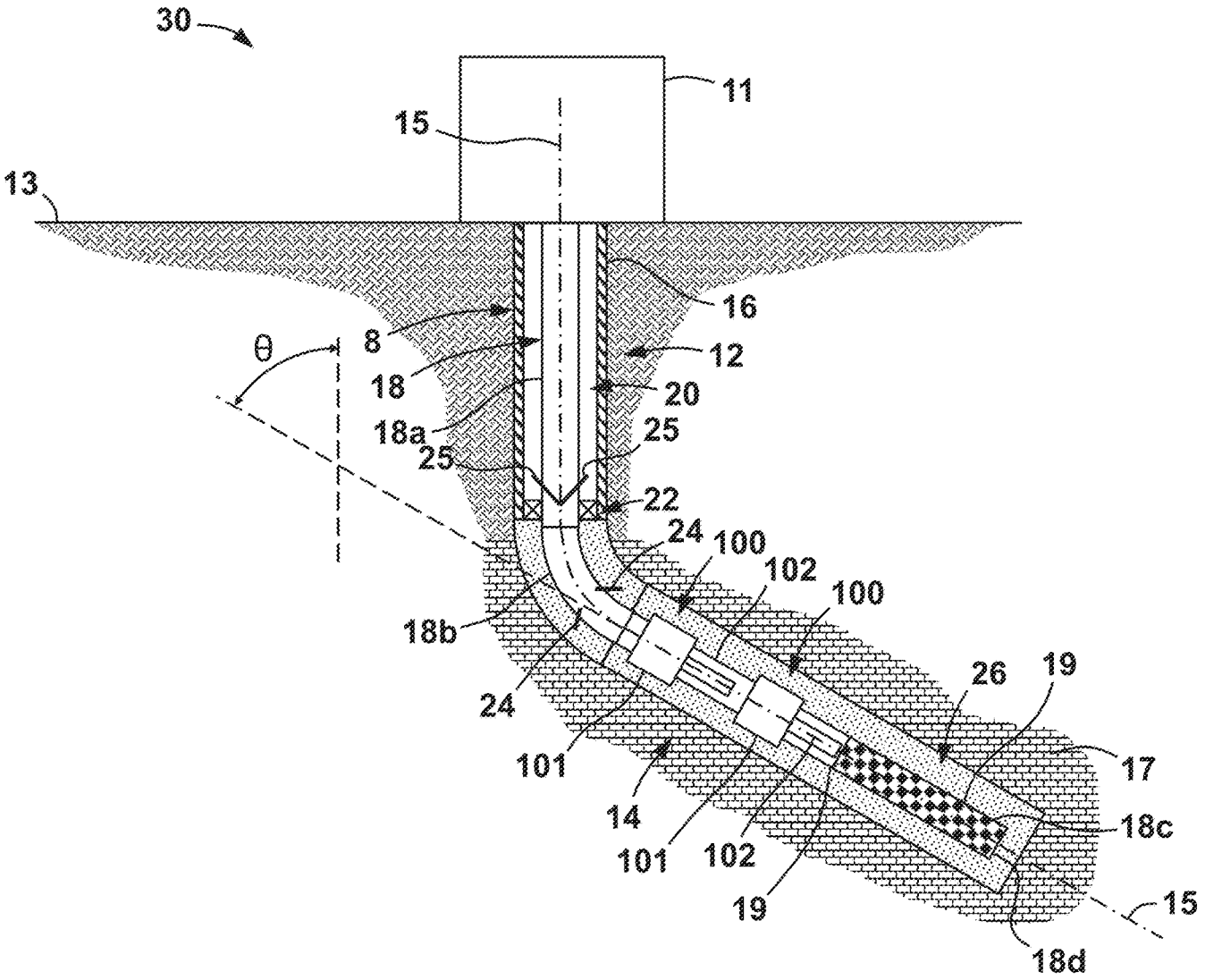
FIG. 2 is a schematic view of another system for producing hydrocarbon fluids from a subterranean wellbore in accordance with at least some embodiments disclosed herein.
Figure 3:
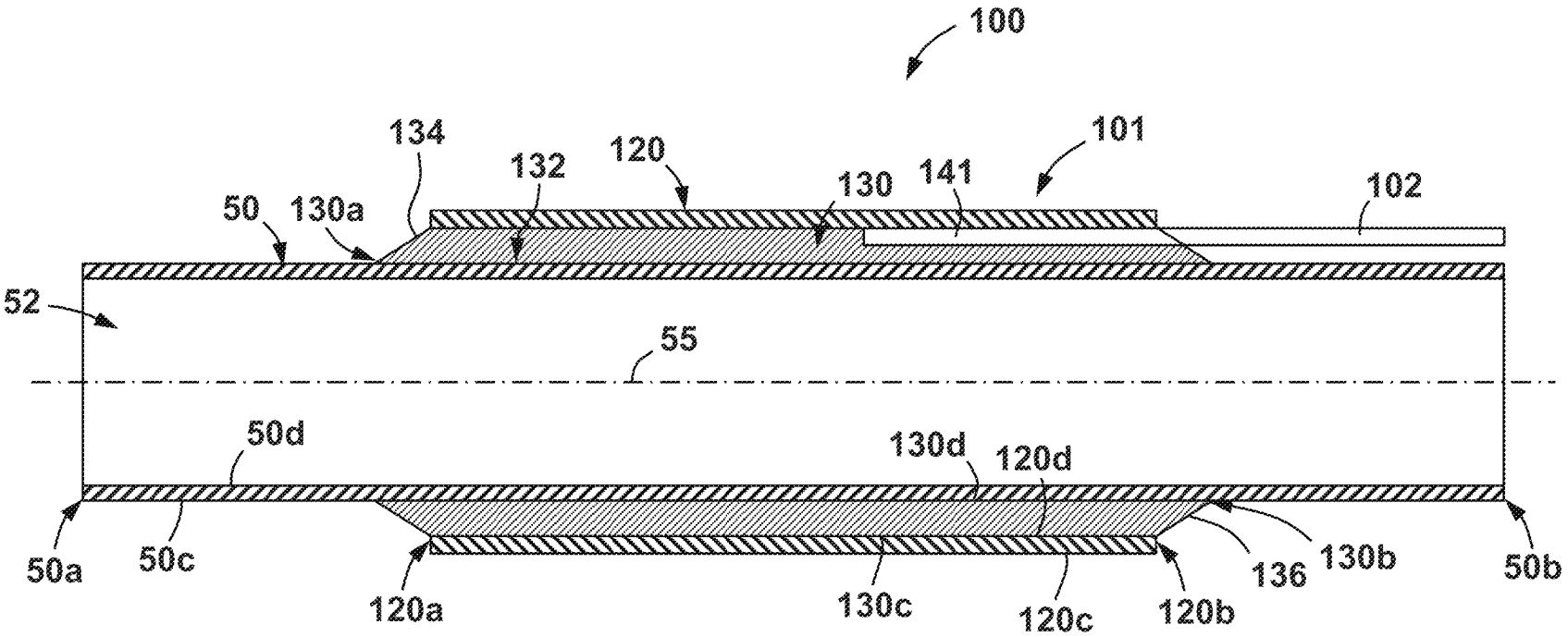
FIG. 3 is a side cross-sectional view of an embodiment of a bypass device for use within the systems of FIG. 1 or FIG. 2.

Referring now to FIG. 2, another system 30 for producing hydrocarbon fluids from a subterranean wellbore 8 extending from the surface 13 along a central or longitudinal axis 15 is shown. System 30 is substantially the same as system 10, previously described, and thus, like reference numerals are used for features of system 30 that are shared with system 10, and the description below will focus on the features of system 30 that are different from system 10. As shown in FIG. 3, system 30 includes a plurality of bypass devices 100 disposed about lower section 18*c* of production string 18, uphole of screens 19 and axially spaced from one another along axis 15 (while two bypass devices 100 are shown in FIG. 2, it should be appreciated that more than two bypass devices 100 may be included along lower section 18*c* in some embodiments.

In this embodiment, each bypass device includes inlet assembly 101 and one or more shunt tubes 102. While note specifically shown, shunt tubes 102 may also include one or more of the outlets 103 previously described above. During operations, inlet assemblies 101 define internal alternative flow paths that allow slurry to flow from lower annulus 26 into shunt tubes 102. Thereafter, the slurry returns to lower annulus 26 at a lower (or more downhole) position by exiting shunt tubes 102 either at a terminal downhole end of the shunt tubes 102 and/or at one or more of the outlets 103 (not shown—see FIG. 1) along tubes 102. As a result, as with the embodiment of FIG. 1, any bridges or blockages within annulus 26 disposed axially between inlet assembly 101 the outlets/end of shunt tubes 102 may be bypassed by the slurry during operations.

Referring now to FIGS. 1 and 2, in addition to gravel bridges and other blockages that occur generally within lower annulus 26, it is also possible that gravel can form additional blockages within the internal flow paths of bypass devices 100 themselves. In the event of such a blockage, the function of devices 100 is frustrated and slurry is once again prevented from progressing downward within annulus 26 as previously described.

In some instances, internal blockages within bypass devices 100 results from the large accumulation or concentration of gravel that tends to settle toward the vertically lower side of lateral section 14 under the force of gravity. Such an over accumulation or concentration of gravel can then enter and ultimately block the alternative flow paths provided by bypass devices 100. The likelihood of such a failure is especially increased when the inlet ports to the alternative flow paths within bypass devices 100 are disposed toward the lower side of annulus 26.

To address these operational difficulties, bypass devices 100 (and particularly entry assemblies 101) are particularly designed to prevent blockages within the alternative flow paths provided within devices 100 such that the functionality of devices 100 is maintained during a completion operation. As a result, through use of the embodiments disclosed herein, a more uniform gravel pack within a subterranean wellbore (e.g., wellbore 8) may be more consistently achieved, such that the potential for lost production from such a wellbore may be decreased overall. Various embodiments of bypass devices 100 are contemplated herein and are described in more detail below with reference to FIGS. 3-18.

Referring now to FIGS. 3-7, one embodiment of bypass device 100 is shown. Referring particularly first to FIG. 3, entry assembly 101 is coupled to a tubular section 50 (or more simply tube 50) of lower section 18*c* of production string 18 and comprises an inner tubular body 130 and a tubular outer covering or shroud 120 disposed about body 130 (note: shroud 120 is not shown in FIGS. 4-7 in order to show the components and features of inner mandrel more clearly).

Figure 4:
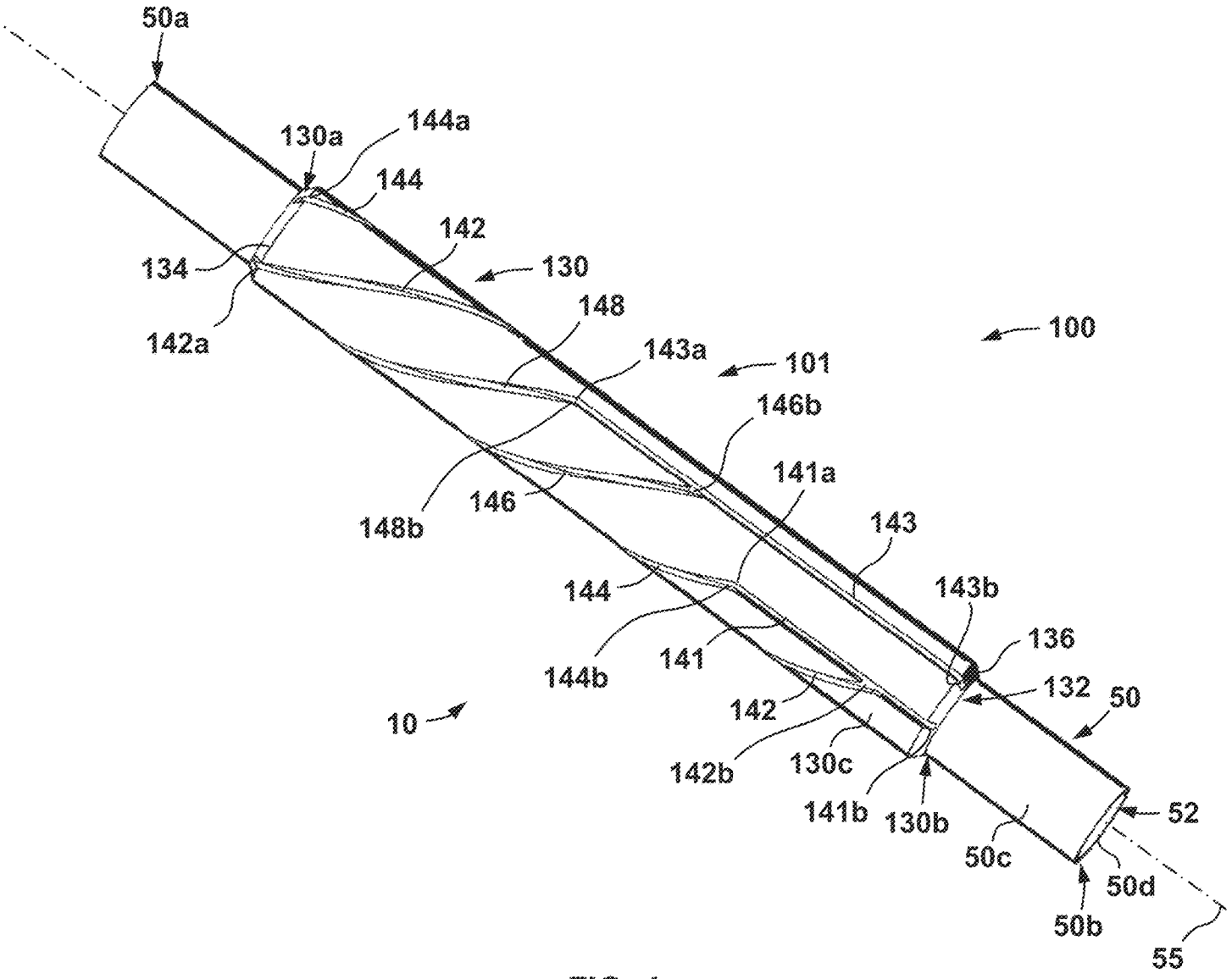
FIGS. 4-7 are different perspective views of the bypass device of FIG. 3.

Referring particular now to FIGS. 3 and 4, tube 50 includes a central or longitudinal axis 55, a first end 50*a*, a second end 50*b* opposite first end 50*a*, a radially outermost cylindrical surface 50*c* extending axially between ends 50*a*, 50*b*, and a radially innermost cylindrical surface 50*d* also extending axially between ends 50*a*, 50*b*. Radially innermost cylindrical surface 50*d* defines a central throughbore 52 extending axially through tube 50. During operations, throughbore 52 makes up part of the central flow bore of lower production section 18*c* of production string 18 (see FIGS. 1 and 2). In addition, during operations, axis 55 may be generally aligned with axis 15 of wellbore 8 (see FIGS. 1 and 2) however, such alignment is not required.

Body 130 is a tubular member that includes a first end 130*a*, a second end 130*b* opposite first end 130*a*, and a cylindrical through passage 132 defined by an innermost cylindrical surface 130*d* (see FIG. 3) extending axially between ends 130*a*, 130*b*. In this embodiment, bypass device 100 is oriented within wellbore 8 (see FIGS. 1 and 2) such that first end 130*a* is uphole of second end 130*b*. In addition, body 130 includes a first frustoconical surface 134 extending from first end 130*a* toward second end 130*b*, a second frustoconical surface 136 extending from second end 130*b* toward first end 130*a*, and an outermost cylindrical surface 130*c* extending axially between frustoconical surfaces 134, 136.

Referring specifically again to FIG. 3, shroud 120 includes a first end 120*a*, a second end 120*b* opposite first end 120*a*, a radially innermost cylindrical surface 120*d* extending axially between ends 120*a*, 120*b*, and a radially outermost cylindrical surface 120*c* also extending axially between ends 120*a*, 120*b*. Shroud 120 is disposed about body 130 such that radially innermost cylindrical surface 120*d* engages with radially outermost cylindrical surface 130*c* of body 130. In this embodiment ends 120*a*, 120*b* of shroud 120 are disposed between frustoconical surfaces 134, 136 such that shroud 120 only extends axially over outermost cylindrical surface 130*c* of body 130.

Figure 5:
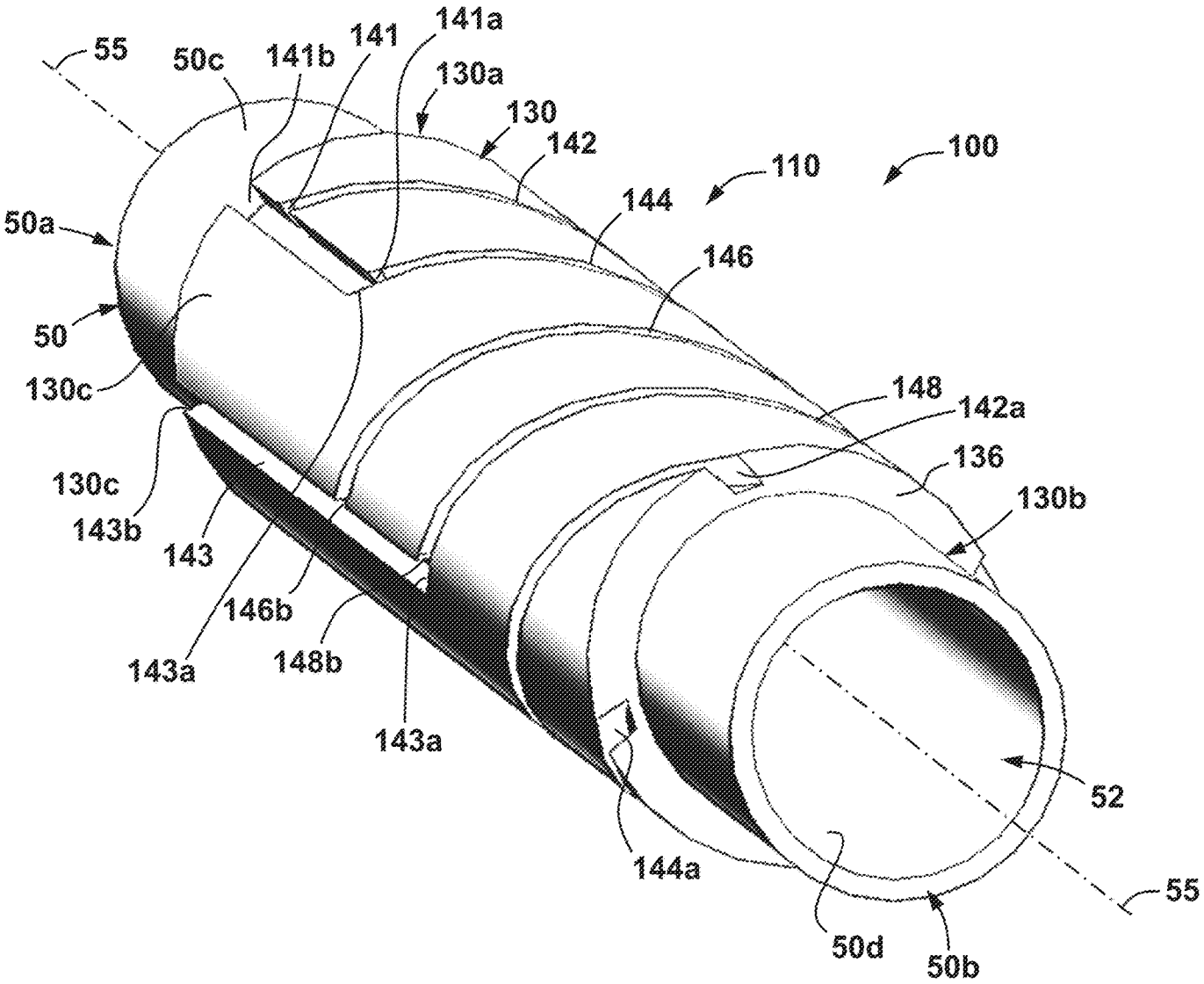
Figure 6:
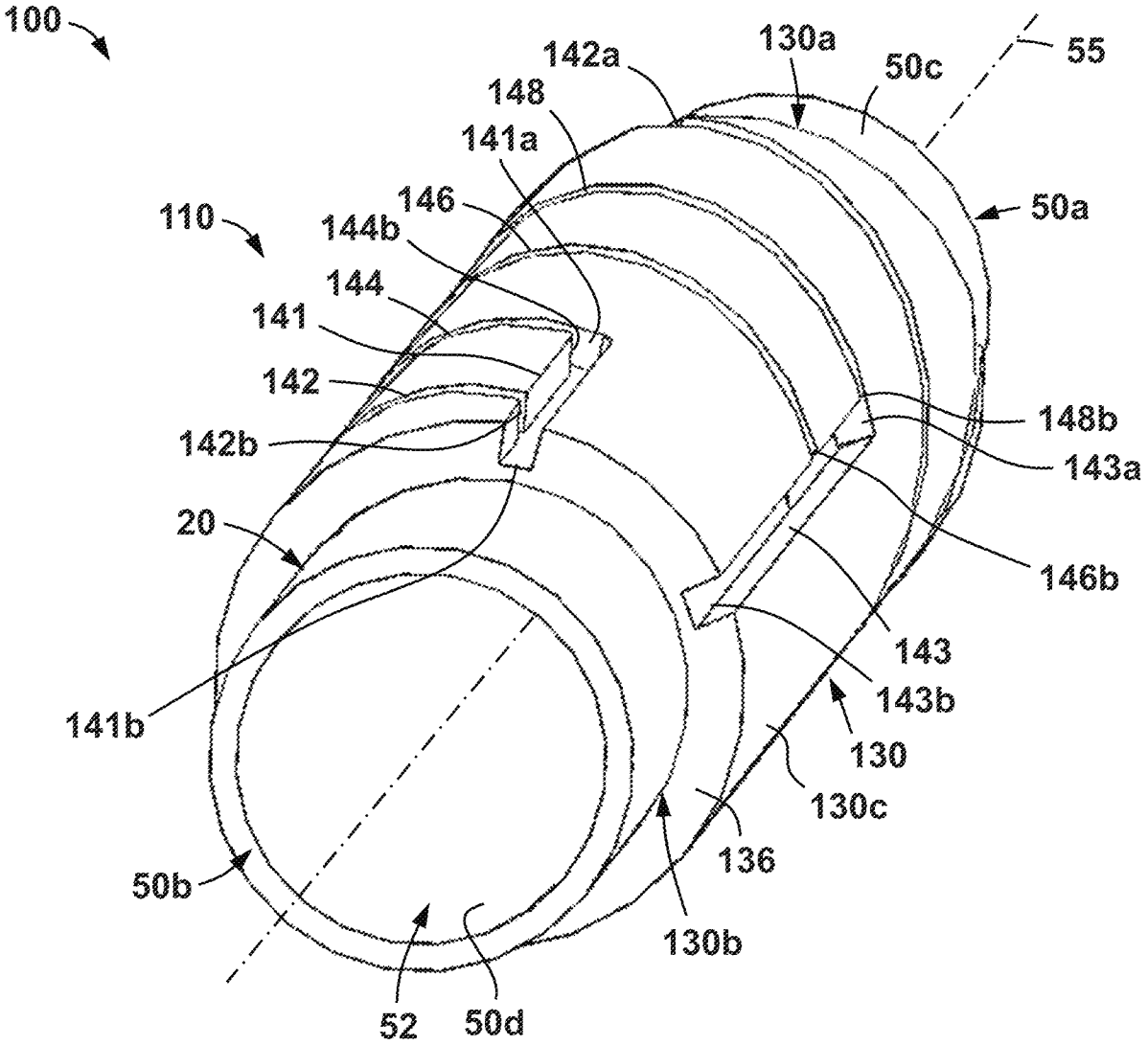

Referring now to FIGS. 4-6, body 130 includes a pair of axially extending outlet channels 141, 143 and a plurality of helically extending inlet channels 142, 144, 146, 148. Each of the outlet channels 141, 143, and inlet channels 142, 144, 146, 148 extend radially inward from radially outermost cylindrical surface 130*c* of body 130. In this embodiment, channels 141, 143, 142, 144, 146, 148 are generally rectangular in cross-section; however, it should be appreciated that channels 141, 143, 142, 144, 146, 148 may have any suitable cross-section in other embodiments, such as, for example triangular, oval, semicircular, etc. Referring briefly again to FIG. 3, when shroud 120 is disposed about body 130 as previously described, channels 141, 143, 142, 144, 146, 148 are each covered by radially innermost cylindrical surface 120*d* of shroud 120 such that together channels 141, 143, 144, 146, 148 and radially innermost cylindrical surface 120*d* of shroud 120 define a plurality of flow passages within entry assembly 101 (note: only one of the outlet channels 141 is shown in FIG. 3).

Referring again to FIGS. 4-6, outlet channels 141, 143 are circumferentially spaced from one another about body 130 and each includes a first end 141*a*, 143*a*, respectively, and a second end 141*b*, 143*b* opposite first end 141*a*, 143*a*, respectively. First ends 141*a*, 143*a* of channels 141, 143, respectively, are disposed between frustoconical surfaces 134, 136 of body 130 and second ends 141*b*, 143*b*, of channels 141, 143, respectively, are disposed at frustoconical surface 136. In this embodiment outlet channel 141 is axially shorter than outlet channel 143 such that first end 143*a* of channel 143 is more proximate first end 130*a* of body 130 than first end 141*a* of channel 141. In addition, as is shown in FIG. 3, second (or downhole) ends 141*b*, 143*b* of outlet channels 141, 143, respectively, are each coupled to or integral with a shunt tube 102 so that fluid (e.g., gravel slurry) may flow from outlet channels 141, 143 into shunt tubes 102 during operations.

Referring still to FIGS. 4-6, each inlet channel 142, 144, 146, 148 extends helically between frustoconical surface 134 and one of the outlet channels 141, 143, previously described. In particular, each channel 142, 144, 146, 148 includes a first end 142*a*, 144*a*, 146*a*, 148*a*, respectively, and a second end 142*b*, 144*b*, 146*b*, 148*b* opposite first end 142*a*, 144*a*, 146*a*, 148*a*, respectively.

First ends 142*a*, 144*a*, 146*a*, 148*a* of inlet channels 142, 144, 146, 148 are each disposed at frustoconical surface 134 and each of the second ends 142*b*, 144*b*, 146*b*, 148*b* is disposed along one of the outlet channels 141, 143. Specifically, second ends 142*b*, 144*b* are disposed along outlet channel 141, with second 144*b* of channel 144 disposed at first end 141*a* and second end 142*b* of channel 142 disposed along channel 141 between ends 141*a*, 141*b*. In addition, second ends 146*b*, 148*b* are disposed along outlet channel 143, with second 148*b* of channel 148 disposed at first end 143*a* and second end 146*b* of channel 146 disposed along channel 143 between ends 143*a*, 143*b*. Thus, inlet channels 142, 144 are in communication with outlet channel 141, and inlet channels 146, 148 are in communication with outlet channel 143. As a result: (1) fluid flowing from first end 142*a* of channel 142 will communicate with channel 141 via the intersection between end 142*b* and channel 141; (2) fluid flowing from first end 144*a* of channel 144 will communicate with channel 141 via the intersection between ends 144*b* and 141*a*; (3) fluid flowing from first end 146*a* of channel 146 will communicate with channel 143 via the intersection between end 146*b* and channel 143; and (4) fluid flowing from first end 148*a* of channel 148 will communicate with channel 143 via the intersection between ends 148*b* and 143*a*.

Figure 7:
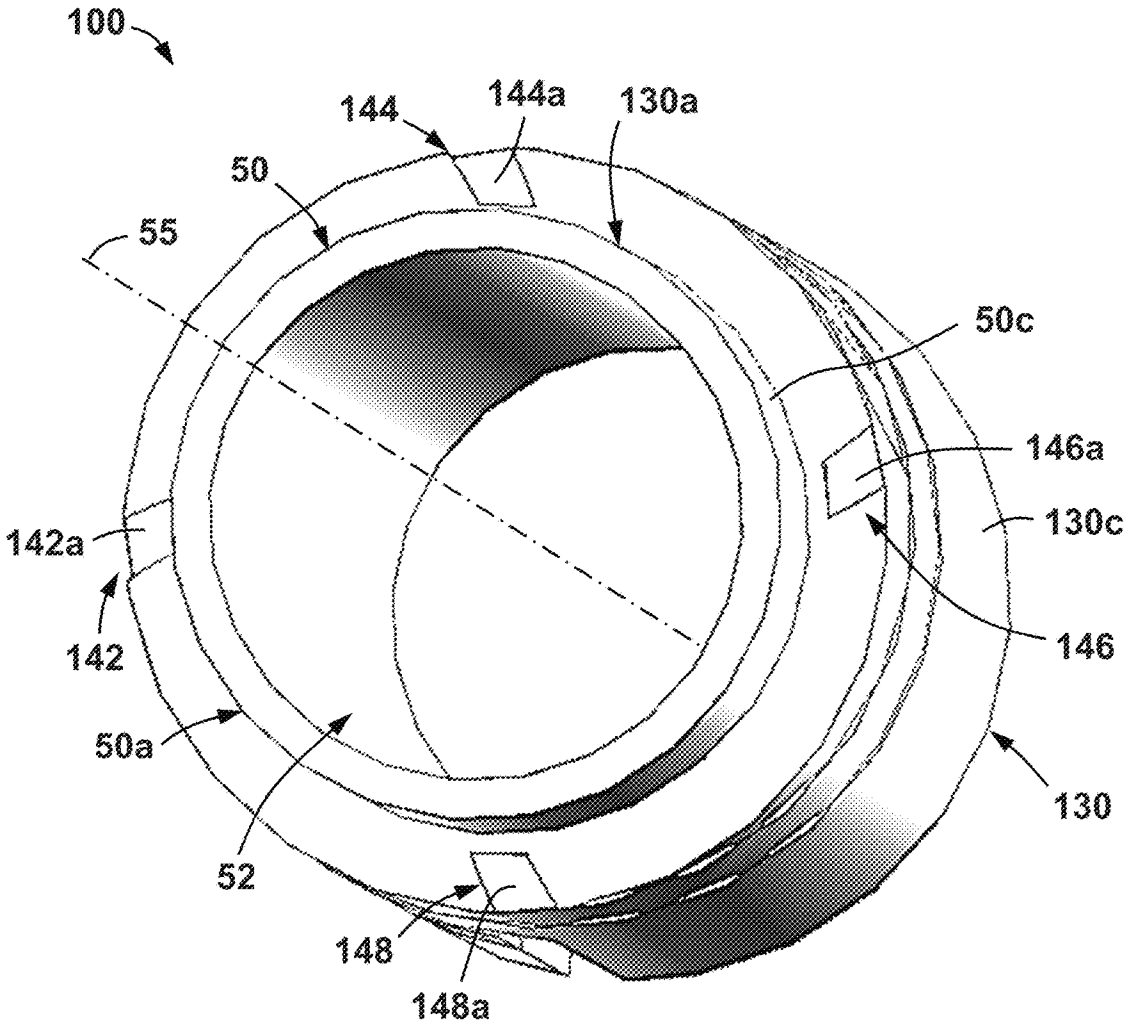

Referring specifically to FIGS. 4 and 7, inlet channels 142, 144, 146 148 are uniformly circumferentially spaced apart from one another along body 130 about axis 55. As a result, in this embodiment, the four inlet channels 142, 144, 146, 148 are each circumferentially spaced approximately 90 from each immediately adjacent inlet channel 142, 144, 146, 148 about body 130. In addition, each of the outlet channels 141, 143 and inlet channels 142, 144, 146, 148 are arranged such that each of the inlet channels 142, 144, 146, 148 extend at least 3600 (or one full revolution) about axis 55 between ends 142*a* and 142*b*, 144*a* and 144*b*, 146*a* and 146*b*, 148*a* and 148*b*, respectively. Further, outlet channels 141, 43 are circumferentially spaced from one another in this embodiment such that channels 141, 143 are disposed on the same side or half (i.e., circumferential half that extends about 1800 about axis 55). In some embodiments channels 141, 143 are circumferentially spaced about 5° to 90°, or from 10° to 60°, or even from 20 to 30 from one another about axis 55.

In some embodiments, inlet channels 142, 144, 146, 148 may include burst discs or other pressure actuated valve members (e.g., valves) that only allow flow of fluid into channels 142, 144, 146, 148 (and therefore into channels 141, 143) when a certain pressure differential is reached.

Referring again to FIGS. 1-4, during a completion operation, slurry (which comprises a carrier fluid and gravel as previously described) is flowed through lower annulus 26 in the manner described above. If a gravel bridge or other blockage should form in lower annulus 26 downhole of uphole end 130*a* of body 130, the slurry may then flow into one or more of the inlet flow channels 142, 144, 146, 148, through outlet channels 141, 143 and shunt tubes 102, and finally back again into lower annulus 26 at a position downhole of the blockage (e.g., via outlets 103 shown in FIG. 1) so that gravel may continue to fill the lower or downhole portions of lower annulus 26. In at least some embodiments, where burst discs or other suitable valve members are included on, along, or within inlet channels, flow through bypass device 100 may be prevented until a certain pressure differential is achieved across ends 130*a*, 130*b* (such as would be caused by a blockage within annulus 26).

Due to the helical orientation and path of inlet channels 142, 144, 146, 148, slurry flowing through channels 142, 144, 146, and 148 may flow "uphill" (or against the force of gravity) for at least some portion of inlet channels 142, 144, 146, 148 prior to the slurry entering outlet channels 141, 143 and thus shunt tubes 102. This uphill flow prevents large slugs or accumulations of gravel from advancing through inlet channels 142, 144, 146, 148 to outlet channels 141, 143 and shunt tubes 102, and instead tends to allow only relatively small concentrations of gravel to advance into outlet channels 141, 143 and shunt tubes 102. As a result, blockages of outlet channels 141, 143 and shunt tubes 102 are prevented (or at least reduced in likelihood), such that fluid communication along the alternative flow paths provided by bypass device 100 may be maintained. In addition, because inlet channels 142, 144, 146, 148 are uniformly circumferentially spaced about axis 55 along body 130, at least some number (e.g., two or three) or the inlet channels 142, 144, 146, 148 may be disposed at the vertically uppermost side of production string 18 within lateral section 14 (relative to the direction of gravity), thereby further preventing the larger accumulations of gravel (which tend to settle toward the vertically bottom side of lateral section 14 as previously described) from entering at least some of the inlet channels in the first place.

Therefore, employing bypass devices 100 along a production string 18 can help to ensure a more complete disbursement of gravel within annulus 26 during completion operations. As a result, use of bypass devices 100 may decrease the chances of lost production from wellbore 8 due to gaps or holes in the gravel pack of lower annulus 26.

Figure 8:
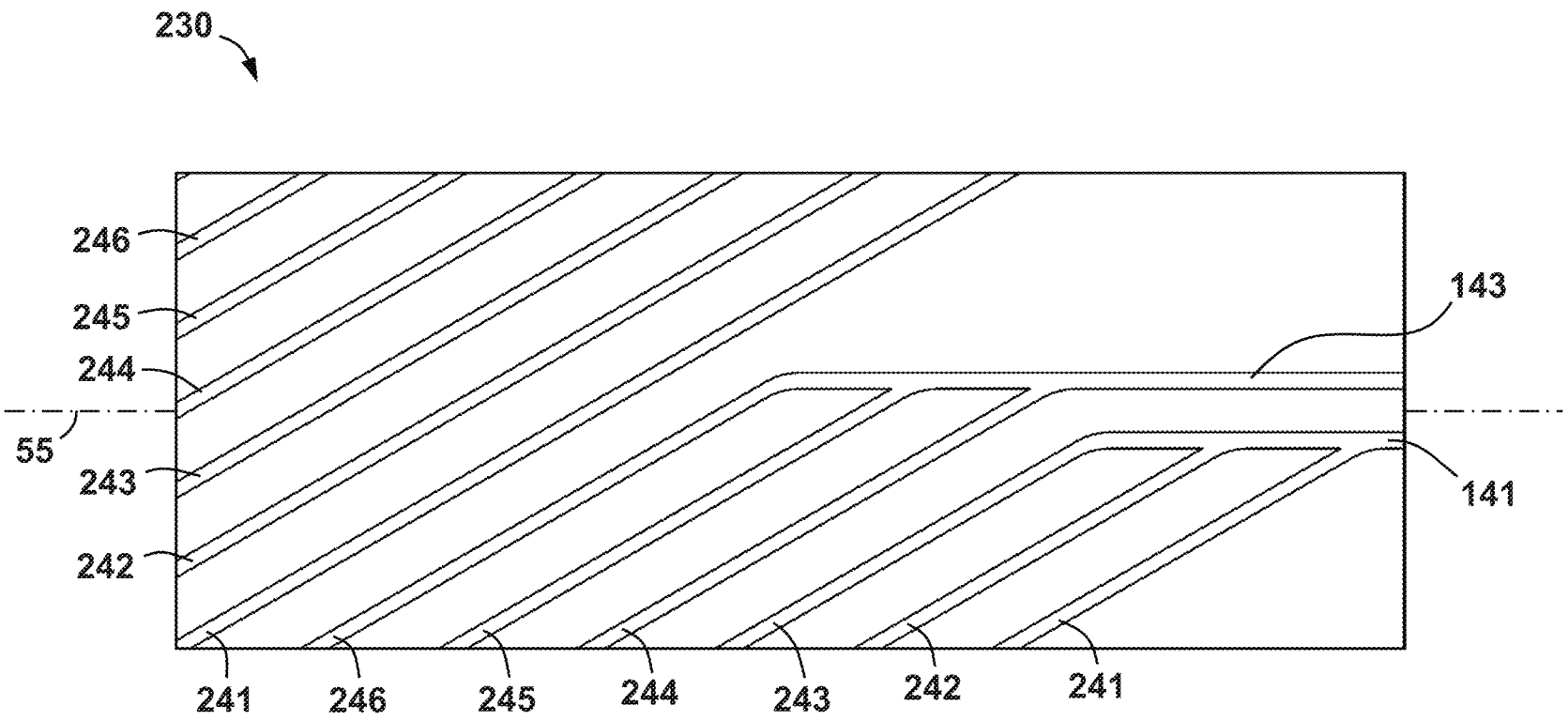
FIGS. 8-10 are side views of embodiments of the inner body of the bypass device of FIG. 3.

Referring briefly now to FIG. 8, another embodiment of inner body 230 of bypass device 100 is shown that can be used in place of body 130 (previously described). In general, body 230 is identical to body 130 (see FIGS. 3-7), except that body 230 includes a total of six inlet flow channels 241, 242, 243, 244, 245, 246 for communicating with outlet flow channels 141, 143 in place of the four inlet flow channels 142, 144, 146, 148 of body 130. All other features of body 230 are the same as body 130, and thus, like reference numbers may be used to refer to the like components (and many such like components are not called out in FIG. 8 so as not to unduly complicate the figure). In this embodiment, as with body 130, inlet flow channels 241, 242, 243, 244, 245, 246 are uniformly circumferentially spaced about axis 55 such that each flow channel 241, 242, 243, 244, 245, 246 is circumferentially spaced approximately 60 from each immediately circumferentially adjacent inlet flow channel. In addition, as with inlet flow channels 142, 144, 146, 148 on body 130, each of the inlet flow channels 241, 242, 243, 244, 245, 246 extends at least 3600 (or at least one full revolution) about axis 55.

By including an increased number of inlet flow channels (e.g., flow channels 241, 242, 243, 244, 245, 246), additional flow paths are created within bypass assembly 100. As a result, it is less likely that all available flow paths through body 230 will be blocked during the completion operations described above. Accordingly, employing body 230 within bypass device 100 in place of body 130 may further enhance the reliability of such completion operations within wellbore 8.

Figure 9:
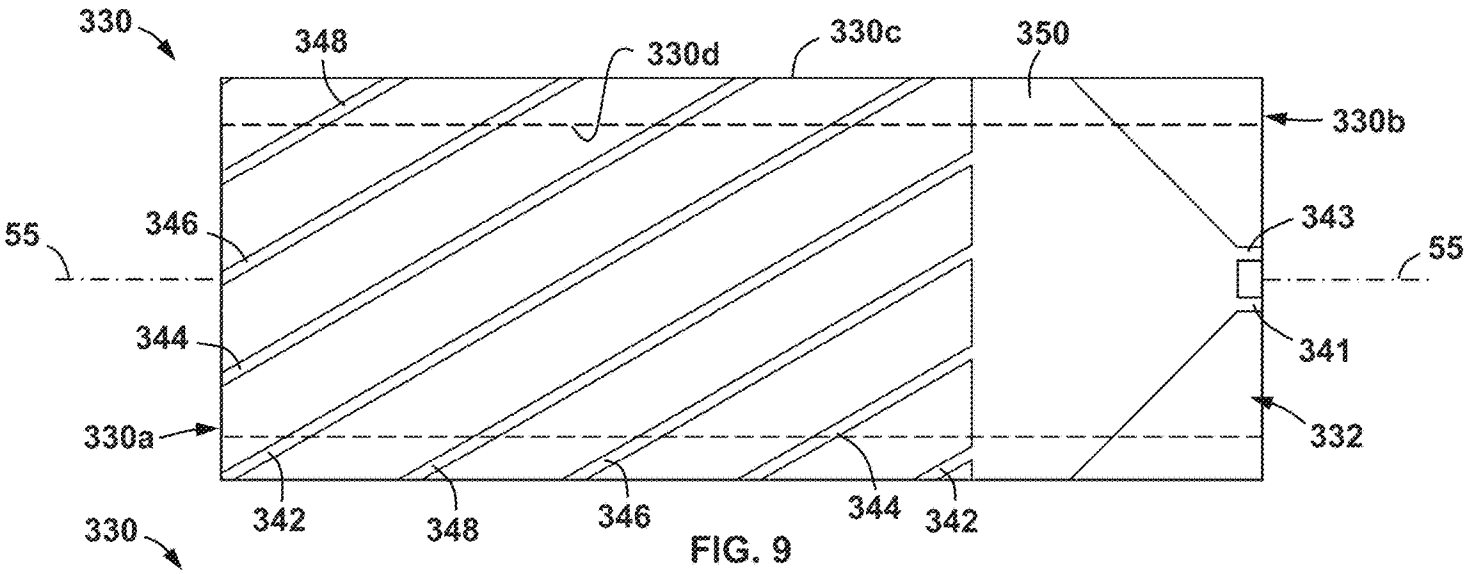

Referring now to FIG. 9, another embodiment of inner body 330 of bypass device 100 is shown that can be used in place of body 130 (previously described). As shown in FIG. 9, body 330 includes a first end 330*a*, a second end 330*b* opposite first end 330*a*, a radially outermost cylindrical surface 330*c* extending axially between ends 330*a*, 330*b*, and a radially innermost cylindrical surface 330*d* also extending axially between ends 330*a*, 330*b*. Radially innermost cylindrical surface 330*d* defines a through passage 332 that receives radially outermost cylindrical surface 50*c* of tube 50 in the same manner as previously described above for body 130 (see FIG. 3). In addition, first end 330*a* may be disposed uphole of second end 330*b* when body 330 is installed within bypass device 100 along production string 18 and production string 18 is inserted within wellbore 8.

Body 330 includes a plurality of helically extending inlet flow channels 342, 344, 346, 348, a pair of axially extending outlet flow channels 341, 343, and a common manifold channel 350 disposed axially between inlet flow channels 342, 344, 346, 348 and outlet flow channels 341, 343. Each of the inlet flow channels 342, 344, 346, 348, outlet flow channels 341, 343, and manifold 350 extend radially inward from radially outermost cylindrical surface 330*c* of body 330. In addition, each inlet flow channel 342, 344, 346, 348 extends helically from first end 330*a* to manifold channel 350, and each outlet flow channel 341, 343 extends axially from manifold channel 350 to second end 330*b* of body 330. As previously described above for body 130, when shroud 120 (see FIG. 3) is disposed about body 330, channels 341, 342, 343, 344, 346, 348 and manifold 350 are each covered by radially innermost cylindrical surface 120*d* of shroud 120 such that together 341, 342, 343, 344, 346, 348, manifold 350, and radially innermost cylindrical surface 120*d* of shroud 120 define a plurality of flow passages within entry assembly (e.g., entry assembly 101) of device 100. In addition, as with inlet flow channels 142, 144, 146, 148 on body 130, each of the inlet flow channels 342, 344, 346, 348 extends at least 3600 (or at least one full revolution) about axis 55 between first end 330*a* and manifold 350.

When body 330 is included within bypass device 100 in place of body 130, fluid (e.g., slurry) is allowed to flow through one or more of the inlet flow channels 342, 344, 346, 348, into manifold 350, and out of one or both of outlet flow channels 341, 343, which would be coupled or mounted to or integral with shunt tubes 102 in the same manner described above for outlet flow channels 141, 143 of body 130. In some embodiments, inlet flow channels 342, 344, 346, 348 are uniformly circumferentially spaced about axis 55 such that each channel 343, 344, 346, 348 is circumferentially spaced approximately 90° from each immediately circumferentially adjacent inlet flow channel.

During operations, the helical path of inlet flow channels 342, 344, 346, 348 provides the same "uphill" flow for any slurry passing therethrough as described above for bypass device 100 and body 130. Therefore, large slugs or accumulations of gravel may not pass into the manifold 350 and outlet channels 341, 343 in substantially the same manner as previously described for body 130. In addition, as with body 130, the uniform circumferential spacing of inlet channels 342, 344, 346, 348 about axis 55 ensures that at least some of the inlet flow channels are disposed toward the vertical upper side of production string 18 thereby decreasing the likelihood that large accumulations of gravel will not enter at least some of the inlet flow channels 342, 344, 346, 348 in the first place. Finally, during operations, if accumulations or slugs of gravel should pass through inlet flow channels 342, 344, 346, 348, the relatively larger volume of manifold 350 may allow any such slugs or accumulations to diffuse and thus prevent such accumulations from further blocking outlet flow channels 341, 343 or shunt tube(s) 102 coupled thereto (see FIGS. 1 and 2).

Figure 10:
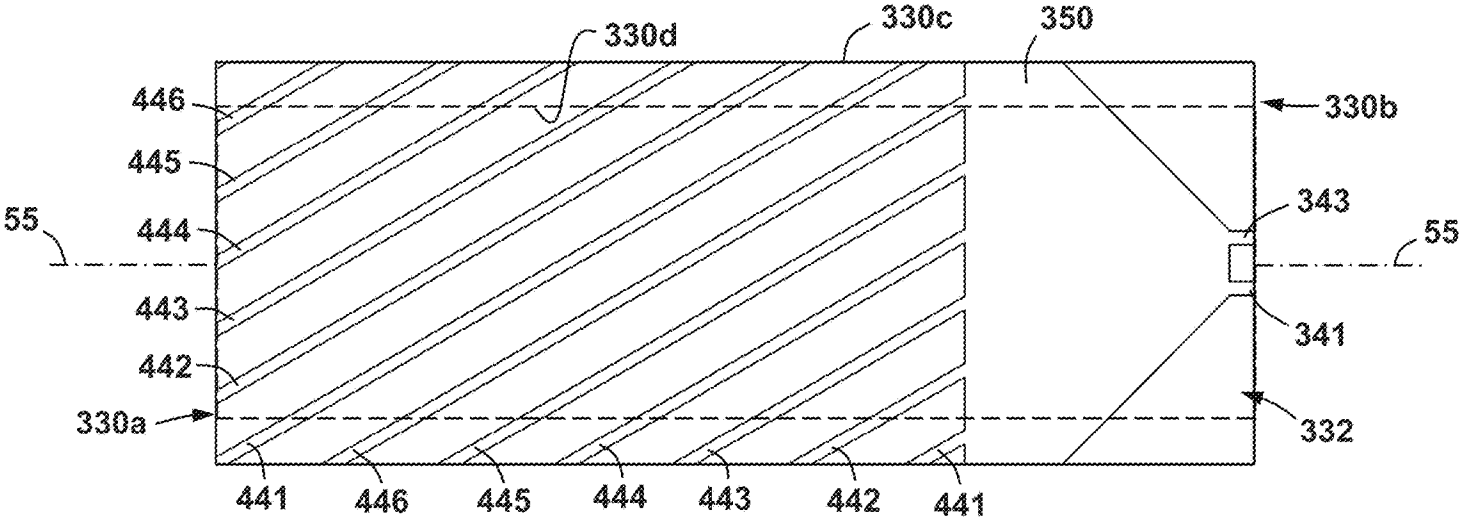

Referring now to FIG. 10, another embodiment of inner body 430 of bypass device 100 is shown. Body 430 is identical to body 330 except that body 430 includes a total of six inlet flow channels 441, 442, 443, 444, 445, 446 in place of the four inlet flow channels 342, 344, 346, 348. In some embodiments, each of the inlet flow channels 441, 442, 443, 444, 445, 446 of body 430 are uniformly circumferentially spaced about axis 55 such that each inlet flow channel is spaced approximately 60° from each immediately circumferentially adjacent inlet flow channel about axis 55. In addition, as with inlet flow channels 142, 144, 146, 148 on body 130, each of the inlet flow channels 441, 442, 443, 444, 445, 446 extends at least 360° (or at least one full revolution) about axis 55 between first end 330*a* and manifold 350. All other features of body 430 that are the same as body 330 are identified with like reference numerals in FIG. 10.

During operations, body 430 provides similar functionality as body 330 except that body 430 includes still additional inlet flow channels (e.g., inlet flow channels 441, 442, 443, 444, 445, 446) such that the likelihood of a complete blockage of fluid flow through the combined channels 441, 442, 443, 444, 445, 446, 341, 343 is further reduced.

Figure 11:
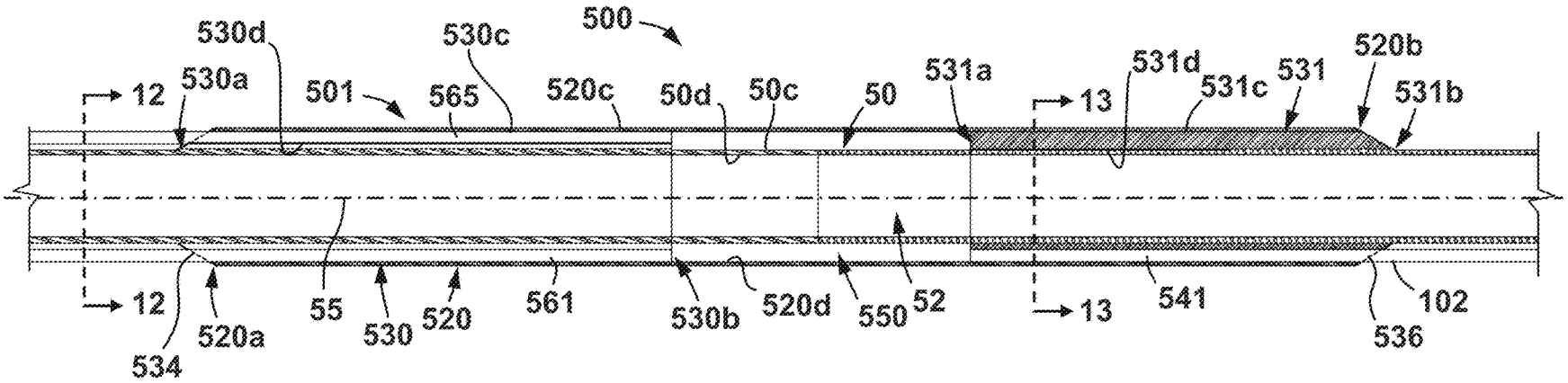
FIG. 11 is a side cross-sectional view of an embodiment of a bypass device for use within the systems of FIG. 1 or FIG. 2.
Figure 13:
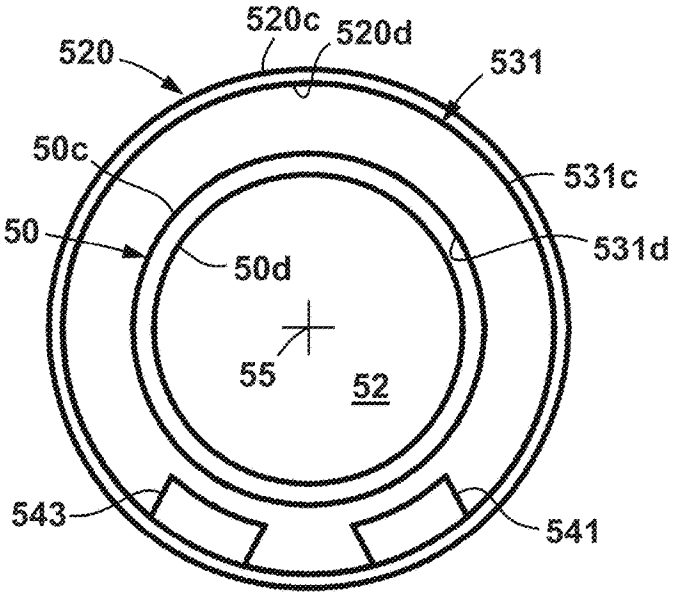
FIG. 13 is a cross-sectional view taken along section 13-13 in FIG. 11.
Figure 12:
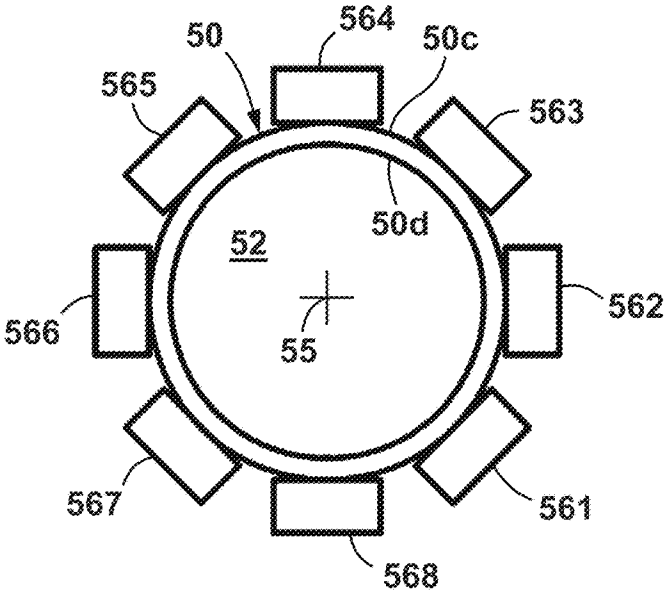
FIG. 12 is a cross-sectional view taken along section 12-12 in FIG. 11.

Referring now to FIGS. 11-13, another embodiment of bypass device 500 which may be used in place of bypass device(s) 100 along production string 18 (see FIGS. 1 and 2) is shown. Referring particularly to FIG. 11, bypass device 500 includes an entry assembly 501 and shunt tubes 102 coupled to and extending axially from entry assembly 501 (wherein tubes 102 are the same as previously described above). Entry assembly 501 is coupled to a tubular section 50 (which is the same as previously described above) and comprises a first inner body member 530, a second body member 531, and an outer covering or shroud 520 disposed about body members 530, 531.

First body member 530 includes a first end 530*a*, a second end 530*b* opposite first end 530*a*, and an innermost cylindrical surface 530*d* extending axially between ends 530*a*, 530*b*. Second body member 531 includes a first end 531*a*, a second end 531*b* opposite first end 531*a*, and an innermost cylindrical surface 531*d* extending axially between ends 531*a*, 531*b*. In this embodiment, bypass device 500 is oriented such that first body member 530 is disposed uphole of second body member 531 and first ends 530*a*, 531*a* of body members 530, 531, respectively are uphole of second ends 530*b*, 531*b*, respectively. In addition, first body member 530 includes a frustoconical surface 534 extending from first end 530*a* toward second end 530*b*, and second body member 531 includes a frustoconical surface 536 extending from second end 531*b* toward first end 531*a*. Further, first body member 530 includes a radially outermost cylindrical surface 530*c* extending axially from frustoconical surface 534 to second end 530*b*, and second body member 531 includes a radially outermost cylindrical surface 531*c* extending axially from first end 531*a* to frustoconical surface 536. First body member 530 and second body member 531 are each disposed about tube 50 such that body members 530, 531 are axially separated or spaced from one another.

Shroud 520 includes a first end 520*a*, a second end 520*b* opposite first end 520*a*, a radially innermost cylindrical surface 520*c* extending axially between ends 520*a*, 520*b*, and a radially outermost cylindrical surface 520*d* also extending axially between ends 520*a*, 520*b*. Shroud 520 is disposed about body members 530, 531 such that first end 520*a* is proximate first end 530*a* of first body member 530, second end 520*b* is proximate second end 531*b* of second body member 531, and radially innermost cylindrical surface 520*d* engages with each of the radially outermost cylindrical surface 530*c* of first body member 530 and the radially outermost cylindrical surface 531*c* of second body member 531. In this embodiment ends 520*a*, 520*b* of cover 520 are disposed axially between frustoconical surfaces 534, 536 such that shroud 520 only extends axially over outermost cylindrical surfaces 530*c*, 531*c* of body members 530, 531 (see FIG. 11).

Referring now to FIGS. 11 and 12, entry assembly 501 further comprises a plurality of inlet tubes 561, 562, 563, 564, 565, 566, 567, 568 extending axially through first body member 530 from frustoconical surface 534 to second end 530*b*. In this embodiment, inlet flow tubes 561, 562, 563, 564, 565, 566, 567, 568 extend axially uphole of frustoconical surface 534; however, in other embodiments, the uphole ends of tubes 561, 562, 563, 564, 565, 566, 567, 568 may be substantially flush or inset (i.e., downhole from) frustoconical surface 534. In this embodiment, there are total of eight inlet flow tubes 561, 562, 563, 564, 565, 566, 567, 568 that are uniformly circumferentially spaced about axis 55 of tube 50, such that each inlet flow tube 561, 562, 563, 564, 565, 566, 567, 568 is spaced approximately 45 from each immediately circumferentially adjacent inlet flow tube about axis 55. In addition, in this embodiment, inlet flow tubes 561, 562, 563, 564, 565, 566, 567, 568 are each rectangular in cross-section; however, it should be appreciated that 561, 562, 563, 564, 565, 566, 567, 568 may include any suitable cross-section in other embodiments (e.g., circular, oval, triangular, square, etc.). While not specifically shown in FIGS. 11 and 12, the uphole end of each of the inlet flow tubes 561, 562, 563, 564, 565, 566, 567, 568 is open such that fluids disposed adjacent the open uphole ends of tubes 561, 562, 563, 564, 565, 566, 567, 568 (e.g., such as fluids within lower annulus 26 in FIGS. 1 and 2) may freely enter tubes 561, 562, 563, 564, 565, 566, 567, 568 during operations. Further, as previously described above, inlet flow tubes 561, 562, 563, 564, 565, 566, 567, 568 may each further include burst discs or other pressure actuated valve members (e.g., valves) that only allow flow of fluid into flow tubes 561, 562, 563, 564, 565, 566, 567, 568 when a certain pressure differential is reached.

Referring now to FIGS. 11 and 13, entry assembly 501 further includes a pair of outlet flow channels 541, 542 extending axially through second body member 531 from frustoconical surface 536 to first end 531*a*. In addition, outlet flow channels 541, 543 extend radially inward from radially outermost cylindrical surface 531*c* of second body 531. When shroud 520 is disposed about second body member 531, radially innermost cylindrical surface 520*d* and outlet flow channels 541, 543 define internal flow paths through second body member 531. In addition, as shown in FIG. 11, outlet flow channels 541, 543 may be coupled to or integral with shunt tubes 102. Referring specifically to FIG. 13, outlet flow channels 541, 543 are circumferentially spaced from one another in this embodiment such that tubes 541, 543 are disposed on the same side or half (i.e., circumferential half that extends about 1800 about axis 55) of body member 531. In some embodiments outlet flow channels 541, 543 are circumferentially spaced about 5° to 90°, or from 10° to 60°, or even from 200 to 300 from one another about axis 55. In addition, in this embodiment, each of the outlet flow channels 541, 543 is rectangular in cross-section; however, as previously described for inlet flow tubes 561, 562, 563, 564, 565, 566, 567, 568, outlet flow tubes 541, 543 may have any suitable cross-section in other embodiments.

Referring specifically again to FIG. 11, because body members 530, 531 are axially separated from one another, body members 530, 531 and shroud 520 further define a common manifold 550 extending radially between radially innermost cylindrical surface 520*d* of shroud 520 and radially outermost cylindrical surface 50*c* of tube 50 and extending axially from second end 530*b* of first body member 530 to first end 531*a* of second body member 531. Thus, manifold 550 places inlet flow tubes 561, 562, 563, 564, 565, 566, 567, 568 in communication with outlet flow channels 541, 543 and shunt tubes 102 during operations.

Referring again to FIGS. 1, 2, and 11-13, during completion operations, slurry (which comprises a carrier fluid and gravel as previously described) is flowed through lower annulus 26 in the manner described above. If a gravel bridge or other blockage should form in lower annulus 26 downhole of uphole end 530*a* of first body member 530, the slurry may then flow into one or more of the inlet flow tubes 561, 562, 563, 564, 565, 566, 567, 568, through manifold 550 and outlet flow channels 541, 543, and finally through and out of shunt tubes 102. Upon exiting shunt tubes 102, the slurry is emitted back again into lower annulus 26 so that the bridge or blockage within annulus 26 is effectively bypassed by slurry and completion operations may continue. In at least some embodiments, where burst discs or other suitable valve members are included on, along, or within inlet tubes 561, 562, 563, 564, 565, 566, 567, 568, flow through bypass device 500 may be prevented until a certain pressure differential is achieved between ends 530*a*, 531*b* of body members 530, 531 (such as would be caused by a blockage within annulus 26).

Because inlet flow tubes 561, 562, 563, 564, 565, 566, 567, 568 are uniformly circumferentially spaced about axis 55 along body 530, at least some number of the inlet tubes 561, 562, 563, 564, 565, 566, 567, 568 may be disposed at the vertically uppermost side of production string 18 within lateral section 14, thereby further preventing the larger accumulations of gravel (which tend to settle toward the vertically bottom portion of the lateral section 14 of wellbore 8 as previously described) from entering at least some of the inlet flow tubes 561, 562, 563, 564, 565, 566, 567, 568 in the first place. In addition, during operations, if accumulations or slugs of gravel should pass through inlet flow tubes 561, 562, 563, 564, 565, 566, 567, 568, the relatively larger volume of manifold 550 may allow any such slugs or accumulations to diffuse and thus prevent such accumulations from further blocking outlet flow channels 541, 543 or shunt tube(s) 102 coupled thereto (see FIGS. 1 and 2).

Therefore, employing bypass devices 500 along a production string 18 can help to ensure a more complete disbursement of gravel within annulus 26 during completion operations. As a result, use of bypass devices 500 may decrease the chances of lost production from wellbore 8 due to gaps or holes in the gravel pack of lower annulus 26.

Figure 14:
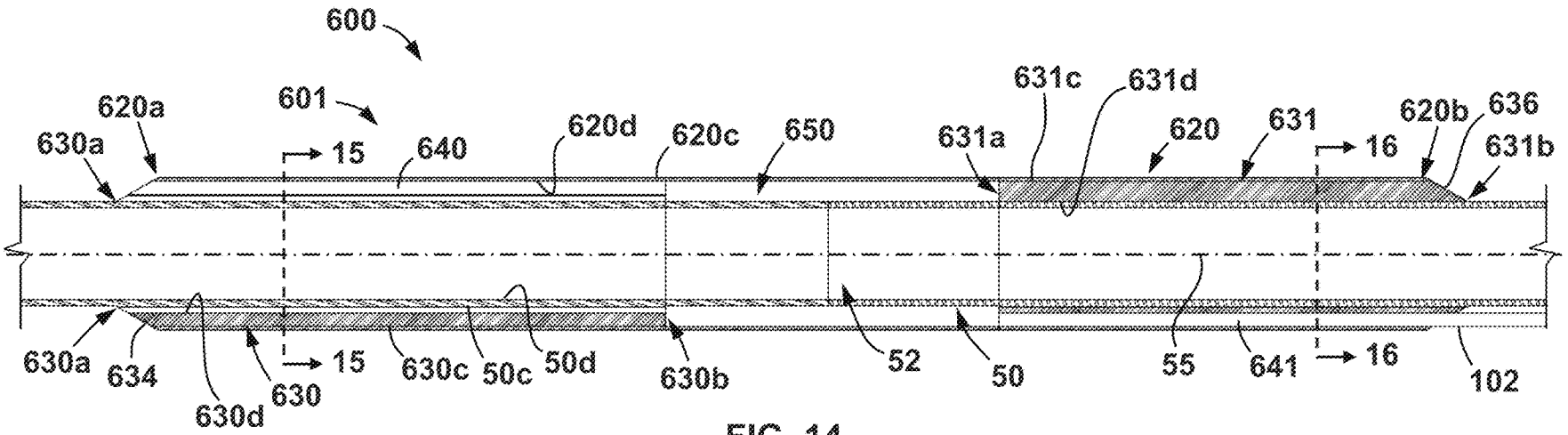
FIG. 14 is a side cross-sectional view of an embodiment of a bypass device for use within the systems of FIG. 1 or FIG. 2.
Figure 16:
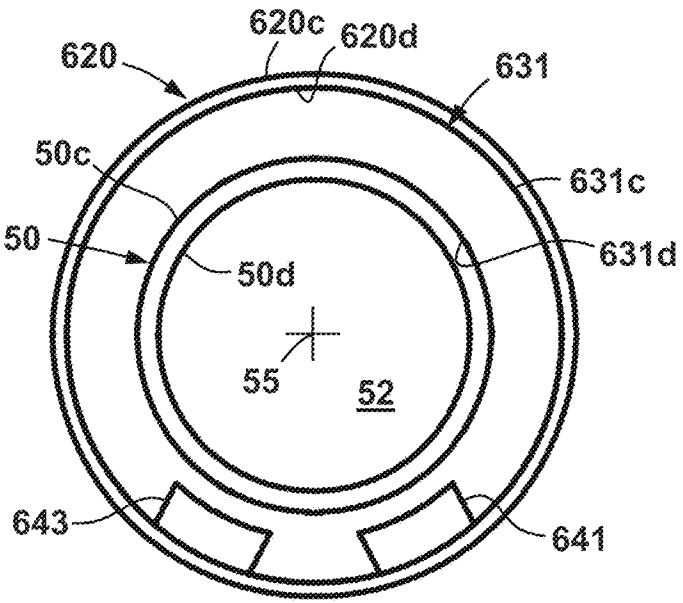
FIG. 16 is a cross-sectional view taken along section 16-16 in FIG. 14.
Figure 15:
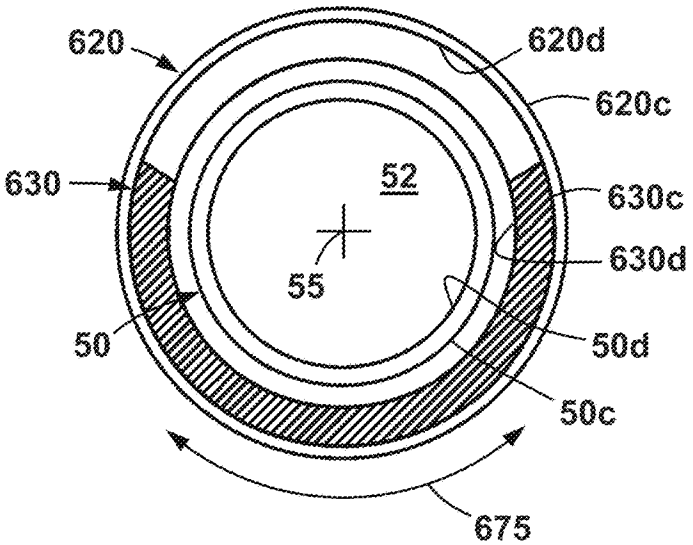
FIG. 15 is a cross-sectional view taken along section 15-15 in FIG. 14.

Referring now to FIGS. 14-16, another embodiment of bypass device 600 which may be used in place of bypass device(s) 100 along production string 18 (see FIGS. 1 and 2) is shown. Referring particularly to FIG. 14, bypass device 600 includes an entry assembly 601 and shunt tubes 102 coupled to and extending axially from entry assembly 601 (wherein tubes 102 are the same as previously described above). Entry assembly 601 is coupled to a tubular section 50 (which is the same as previously described above) and comprises a first inner body member 630, a second inner body member 631, and an outer covering or shroud 620 disposed about body members 630, 631.

First body member 630 includes a first end 630*a*, a second end 630*b* opposite first end 630*a*, and an innermost cylindrical surface 630*d* extending axially between ends 630*a*, 630*b*. Second body member 631 includes a first end 631*a*, a second end 631*b* opposite first end 631*a*, and an innermost cylindrical surface 631*d* extending axially between ends 631*a*, 631*b*. In this embodiment, bypass device 600 is oriented such that first body member 630 is disposed uphole of second body member 631 and first ends 630*a*, 631*a* of body members 630, 631, respectively are uphole of second ends 630*b*, 631*b*, respectively. In addition, body member 630 includes a frustoconical surface 634 extending from first end 630*a* toward second end 630*b*, and second body member 631 includes a frustoconical surface 636 extending from second end 631*b* toward first end 631*a*. Further, first body member 630 includes a radially outermost cylindrical surface 630*c* extending axially from frustoconical surface 634 to second end 630*b*, and second body member 631 includes a radially outermost cylindrical surface 631*c* extending axially from first end 631*a* to frustoconical surface 636. First body member 630 and second body member 631 are each disposed about tube 50 such that body members 630, 631 are axially separated or spaced from one another.

Shroud 620 includes a first end 620*a*, a second end 620*b* opposite first end 620*a*, a radially innermost cylindrical surface 620*c* extending axially between ends 620*a*, 620*b*, and a radially outermost cylindrical surface 620*d* also extending axially between ends 620*a*, 620*b*. Shroud 620 is disposed about body members 630, 631 such that first end 620*a* is proximate first end 630*a* of first body member 630, second end 620*b* is proximate second end 631*b* of second body member 631, and radially innermost cylindrical surface 620*d* engages with each of the radially outermost cylindrical surface 630*c* of first body member 630 and the radially outermost cylindrical surface 631*c* of second body member 631. In this embodiment ends 620*a*, 620*b* of cover 620 are disposed axially between frustoconical surfaces 634, 636 such that shroud 620 only extends axially over outermost cylindrical surfaces 630*c*, 631*c* of body members 630, 631 (see FIG. 14).

Referring specifically to FIGS. 14 and 15, first body member 530 is an arcuate member that does not extend totally circumferentially (or a full 360°) about axis 55. In some embodiments, first body member 630 extends from about 1800 to about 350 about axis 55, and in other embodiments extends from about 200 to 3000 about axis 55, and in still other embodiments extends from about 250 to 3000 about axis 55. Therefore, an arcuate or angular void or gap (or partial annulus) is formed radially between radially innermost cylindrical surface 620*d* of shroud 620 and radially outermost cylindrical surface 50*c* of tube 50 that extends axially between ends 630*a*, 630*b* of first body member 630. This arcuate void forms an inlet flow channel 640 within entry assembly 601 that extends axially from frustoconical surface 634 to second end 630*b* of first body member 630 and radially inward from radially outermost cylindrical surface 630*c* of body member 630 to radially outermost cylindrical surface 50*c* of tube 50. When shroud 620 is disposed about first body member 630 as previously described, inlet flow channel 640 and radially innermost cylindrical surface 620*d* of shroud 620 define an internal flow paths through first body member 530, such that fluids (e.g., slurry) are allowed to freely enter and flow through inlet flow channel 640 to advance between ends 630*a*, 630*b* of first body member 630 during operations.

In addition, as shown in FIG. 15, first body member 630 is pivotable (or is configured to pivot freely) about axis 55 in the radial space between shroud 620 and tube 50 (e.g., as indicated by directional arrow 675). Any suitable device or mechanism for facilitating the pivoting of first body member 630 about axis 55 relative to shroud 620, tube 50, and second body member 631 may be employed, such as, for example, bearings, a smooth bore sliding engagement between body member 630 and shroud 620 and/or tube 50, circumferential ribs and corresponding recesses, etc. However, it should be appreciated that body member 630 may not translate axially along tube 50, which again may be facilitated by any suitable device or mechanism (e.g., circumferential ribs or other stop mechanisms along tube 50 and/or shroud 620). As first body member 630 pivots about axis 55 as described above, inlet flow channel 640 also necessarily may pivot about axis 55 simultaneously. Due to the weight of first body member 630, when bypass device 500 is placed laterally (e.g., such as would be the case when bypass device 600 is installed on production string 18 and production string 18 is inserted within lateral section 14 of wellbore 8 in the manner shown in FIG. 1), the first body member 630 will naturally pivot about 55 axis to orient itself along the vertically lowermost side of axis 55 with respect to gravity. As a result, when device 600 is placed in a lateral (or at least partially lateral) orientation, inlet flow channel 640 should self-orient toward the vertically upper most side of axis 55 with respect to gravity.

Referring still to FIGS. 14 and 16, entry assembly 601 further includes a pair of outlet flow channels 641, 643 extending axially through second body member 631 from frustoconical surface 636 to first end 631*a*. Outlet flow channels 641, 643 extend radially inward from radially outermost cylindrical surface 631*c* of second body member 631. Thus, when shroud 620 is disposed about second body member 631 as previously described, outlet flow channels 641, 643 and radially innermost cylindrical surface 620*d* of shroud 620 form internal flow paths that extend through second body member 631.

As shown in FIG. 14, outlet flow channels 641, 643 may be coupled to or integral with shunt tubes 102. Referring specifically to FIG. 16, outlet flow channels 641, 643 are circumferentially spaced from one another in this embodiment such that channels 641, 643 are disposed on the same side or half (i.e., circumferential half that extends about 1800 about axis 55) of body member 631. In some embodiments channels 641, 643 are circumferentially spaced about 5° to 90°, or from 10° to 60°, or even from 200 to 300 from one another about axis 55. In addition, in this embodiment, each of the outlet flow channels 641, 643 is rectangular in cross-section; however, as previously described for outlet flow channels 541, 543 in the embodiment of FIGS. 11-13, outlet flow channels 641, 643 may have any suitable cross-section in other embodiments.

Referring specifically now to FIG. 14, because body members 630, 631 are axially spaced from one another, body members 630, 631 and shroud 620 further define a common manifold 650 extending radially between radially innermost cylindrical surface 620*d* of shroud 620 and radially outermost cylindrical surface 50*c* of tube 50 and extending axially from second end 630*b* of first body member 630 to first end 631*a* of second body member 631. Thus, manifold 650 places inlet flow inlet flow channel 640 in communication with outlet flow tubes 641, 643 and shunt tubes 102.

Referring again to FIGS. 1 and 14-16, during completion operations, slurry (which comprises a carrier fluid and gravel as previously described) is flowed through lower annulus 26 in the manner described above. If a gravel bridge or other blockage should form in lower annulus 26 downhole of uphole end 630*a* of first body member 630, the slurry may then flow into inlet flow channel 640 and then through manifold 650 and outlet flow channels 641, 643 and shunt tubes 102. Upon exiting shunt tubes 102, the slurry is emitted back again into lower annulus 26 so that the bridge or blockage within annulus 26 is effectively bypassed by slurry and completion operations may continue.

Because first body member 630 is free to pivot about axis 55 and thus self-orients itself to the vertically lower side of lateral section 14 of wellbore 8 under the force of gravity as previously described, inlet flow channel 640 should always be disposed at the vertically uppermost side of production string 18 within lateral section 14, thereby preventing larger accumulations of gravel (which tend to settle toward the vertically bottom portion of the wellbore and can cause a blockage within the alternative flow paths within bypass device 600 as previously described) from entering inlet flow channel 640 during operations. In addition, during operations, if accumulations or slugs of gravel should pass through inlet flow channels 640, the relatively larger volume of manifold 650 will allow any such slugs or accumulations to diffuse and thus prevent such accumulations from further blocking outlet flow channels 641, 643 or shunt tube(s) 102 coupled thereto (see FIGS. 1 and 2).

Therefore, employing bypass devices 600 along a production string 18 can help to ensure a more complete disbursement of gravel within annulus 26 during completion operations. As a result, use of bypass devices 600 may decrease the chances of lost production from wellbore 8 due to gaps or holes in the gravel pack of lower annulus 26.

Figure 17:
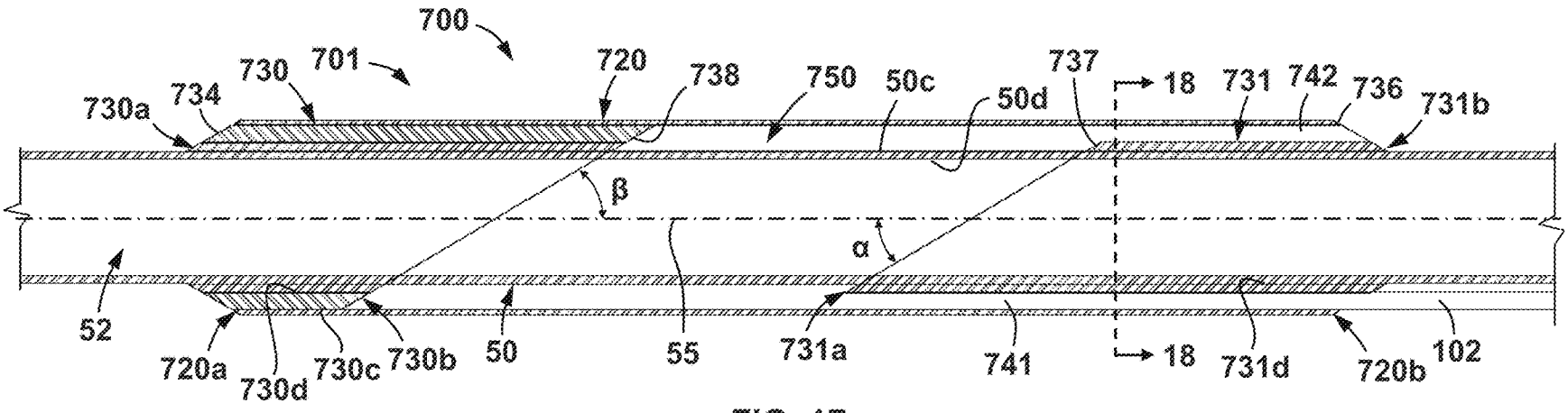
FIG. 17 is a side cross-sectional view of an embodiment of a bypass device for use within the systems of FIG. 1 or FIG. 2.
Figure 18:
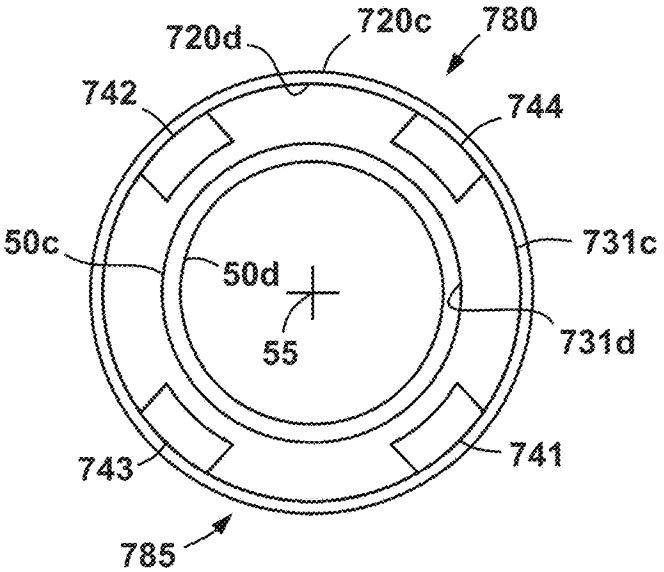
FIG. 18 is a cross-sectional view taken along section 18-18 in FIG. 17.

Referring now to FIGS. 17 and 18, another embodiment of bypass device 700 which may be used in place of bypass device(s) 100 along production string 18 (see FIGS. 1 and 2) is shown. Referring particularly to FIG. 17, bypass device 700 includes an entry assembly 701 and shunt tubes 102 coupled to and extending axially from entry assembly 701 (note: only one shunt tube 102 is shown in FIG. 17 and tubes 102 are the same as previously described above). Entry assembly 701 is coupled to tubular section 50 (which is the same as previously described above) and comprises a first inner body member 730, a second inner body member 731, and an outer covering or shroud 720 disposed about body members 730, 731.

First body member 730 includes a first end 730*a*, a second end 730*b* opposite first end 730*a*, and an innermost cylindrical surface 730*d* extending axially between ends 730*a*, 730*b*. Second body member 731 includes a first end 731*a*, a second end 731*b* opposite first end 731*a*, and an innermost cylindrical surface 731*d* extending axially between ends 731*a*, 731*b*. In this embodiment, bypass device 700 is oriented such that first body member 730 is disposed uphole of second body member 731 and first ends 730*a*, 731*a* of body members 730, 731, respectively are uphole of second ends 730*b*, 731*b*, respectively. In addition, first body member 730 includes a frustoconical surface 734 extending from first end 730*a* toward second end 730*b*, and second end 730*b* comprises a planar angled surface 738 that extends at an angle β relative to axis 55 that ranges from about 0° to about 90°. Further, second body member 731 includes a frustoconical surface 736 extending from second end 731*b* toward first end 731*a*, and first end 731*a* comprises a planar angled surface 737 that extends at an angle α relative to axis 55 that ranges from about 0° to about 90°. In this embodiment the angles β and α are the same; however, in other embodiments, the angles Rand a may be different. Further, first body member 730 includes a radially outermost cylindrical surface 730*c* extending axially from frustoconical surface 734 to planar angled surface 738, and second body member 631 includes a radially outermost cylindrical surface 731*c* (see FIG. 18) extending axially from planar angled surface 737 to frustoconical surface 736. First body member 730 and second body member 731 are each disposed about tube 50 such that body members 730, 731 are axially separated from one another.

Shroud 720 includes a first end 720*a*, a second end 720*b* opposite first end 720*a*, a radially innermost cylindrical surface 720*c* extending axially between ends 720*a*, 720*b*, and a radially outermost cylindrical surface 720*d* also extending axially between ends 720*a*, 720*b*. Shroud 720 is disposed about body members 730, 731 such that first end 720*a* is proximate first end 730*a* of first body member 730, second end 720*b* is proximate second end 731*b* of second body member 731, and radially innermost cylindrical surface 720*d* engages with each of the radially outermost cylindrical surface 730*c* of first body member 730 and the radially outermost cylindrical surface 731*c* of second body member 731. In this embodiment ends 720*a*, 720*b* of shroud 720 are disposed axially between frustoconical surfaces 734, 736 such that shroud 720 only extends axially over outermost cylindrical surfaces 730*c*, 731*c* of body members 730, 731.

Referring still to FIGS. 17 and 18, two inlet flow channels 742, 744 and two outlet flow channels 741, 743 are formed on body member 731, with each flow channel 742, 744, 741, 743 each extending both radially inward from radially outermost cylindrical surface 731*c* and axially along axis 55 between surfaces 737, 736. As best shown in FIG. 18, inlet flow channels 742, 744 are circumferentially separated from outlet flow channels 741, 743 such that inlet flow channels 741, 743 such that inlet flow channels 742, 744 are disposed on one circumferential side 780 of body member 731 and outlet flow channels 741, 743 are disposed on an opposing circumferential side 785 of body member 731 from side 780. Each of the first circumferential side 780 and the second circumferential side 785 cover approximately 1800 of body member 731 about axis 55. Thus inlet flow channels 742, 744 are circumferentially adjacent one another about axis 55 and outlet flow channels 741, 743 are circumferentially adjacent one another about axis 55. In some embodiments inlet flow channels 742, 744 are circumferentially spaced about 5° to 90°, or from 10° to 60°, or even from 20° to 30° from one another about axis 55, and outlet flow channels 741, 743 are circumferentially spaced about 5° to 90°, or from 10° to 60°, or even from 200 to 30 from one another about axis 55. Further, as is also best shown in FIG. 18, each of the inlet flow channels 742, 744 and outlet flow channels 741, 743 are generally rectangular in cross-section; however, other cross-sections are possible in other embodiments, such as, for example, circular, oval, triangular, etc. Still further, as best shown in FIG. 17, outlet flow channels 741, 743 may be coupled to or integral with shunt tubes 102. As shown in FIGS. 17 and 18, when shroud 720 is disposed about body member 731, flow channels 741, 742, 743, 744 and radially innermost cylindrical surface 720*d* of shroud form internal flow paths that extend across second body member 731.

Referring specifically now to FIG. 17, because body members 730, 731 are axially separated from one another, body members 730, 731 and shroud 720 further define a common manifold 750 extending radially between radially innermost cylindrical surface 720*d* of shroud 720 and radially outermost cylindrical surface 50*c* of tube 50 and extending axially from planar angled surface 738 on second end 730*b* of first body member 730 to planar angled surface 737 on first end 731*a* of second body member 731. Thus, manifold 750 places inlet flow inlet flow channels 742, 744 in communication with outlet flow channels 741, 743 and shunt tubes 102.

Referring again to FIGS. 1, 2, 17, and 18, during completion operations, slurry (which comprises a carrier fluid and gravel as previously described) is flowed through lower annulus 26 in the manner described above. If a gravel bridge or other blockage should form in lower annulus 26 downhole of downhole end 731*b* of body member 731, the slurry may then flow back uphole into inlet flow channels 742, 744, through manifold 750 and outlet flow channels 741, 743 and finally through shunt tubes 102. Upon exiting shunt tubes 102, the slurry is emitted back again into lower annulus 26 so that the bridge or blockage within annulus 26 is effectively bypassed by slurry and completion operations may continue.

Because inlet flow channels 742, 744 are disposed on second body member 731, slurry must enter inlet flow channels 742, 744 from the downhole end of bypass device 700. As a result, the general downhole flow direction of the slurry (due to both gravity and the pressure differential caused by the pumping of slurry into the wellbore) any large accumulations or slugs of gravel within the slurry will tend to continue flowing downhole past inlet flow channels 742, 744 and will therefore be prevented from entering inlet flow channels 742, 744. Therefore, there is a reduced likelihood that such slugs or accumulations of gravel will form a blockage within inlet flow channels 742, 744 during operations. In addition, during operations, if accumulations or slugs of gravel should pass through inlet flow channels 742, 744, the relatively larger volume of manifold 750 will allow any such slugs or accumulations to diffuse and thus prevent such accumulations from further blocking outlet flow channels 741, 743 or shunt tubes 102 coupled thereto (see FIG. 1). In some embodiments, where burst discs or other suitable valve members are included on, along, or within inlet channels 742, 744, flow through bypass device 700 may be prevented until a certain pressure differential is achieved (such as would be caused by a blockage within annulus 26).

Therefore, employing bypass devices 700 along a production string 18 can help to ensure a more complete disbursement of gravel within annulus 26 during completion operations. As a result, use of bypass devices 700 may decrease the chances of lost production from wellbore 8 due to gaps or holes in the gravel pack of lower annulus 26.

While exemplary embodiments have been shown and described, other modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A production system for a subterranean wellbore, the system comprising:

a production string disposed within the wellbore, wherein the production string has a central axis and includes an axially extending internal throughbore;

a plurality of screens disposed along the production string, wherein an annulus is formed between the production string and the wellbore that is in fluid communication with the internal throughbore via the plurality of screens; and a bypass device coupled to the production string, wherein the bypass device comprises an inlet assembly and a shunt tube coupled to the inlet assembly, wherein the shunt tube is in fluid communication with the annulus;

wherein the inlet assembly comprises:

a plurality of inlet flow paths extending helically about the central axis from an uphole end of the inlet assembly, wherein the inlet flow paths are fluidly coupled to the annulus and extend at least 360° about the central axis;

a tubular body disposed about the production string, wherein the tubular body comprises a radially outermost surface and an outlet channel extending radially inward form the radially outermost surface;

a tubular shroud disposed about the tubular body, wherein the tubular shroud comprises a radially innermost surface; and an outlet flow path formed by the outlet channel and the radially innermost surface of the tubular shroud that extends to a downhole end of the inlet assembly wherein the outlet flow path is fluidly coupled to the shunt tube and the plurality of inlet flow paths.

2. The production system of claim 1, wherein the plurality of inlet flow paths are uniformly circumferentially spaced about the central axis.

3. The production system of claim 2, wherein the inlet assembly further comprises a manifold axially disposed between the inlet flow paths and the outlet flow path, wherein the manifold is in fluid communication with each of the inlet flow paths and the outlet flow path.

4. The production system of claim 1, wherein the outlet flow path extends axially with respect to the central axis.

5. The production system of claim 1, wherein the tubular body comprises:

a first end, and a second end opposite the first end, wherein the radially outermost surface extends between the first end and the second end; and a plurality of inlet channels extending radially inward from the radially outermost surface, wherein the plurality of inlet channels extend helically about the central axis from the first end of the tubular body;

wherein the outlet channel extends axially to the second end of the tubular body; and the radially innermost surface and the plurality of inlet channels form the plurality of inlet flow paths.

6. The production system of claim 5, wherein the outlet flow channel extends from the plurality of inlet flow channels to the second end of the body.

7. The production system of claim 5, wherein the body comprises a manifold channel extending radially inward from the radially outermost surface, wherein the manifold channel extends axially from the plurality of inlet channels to the outlet channel, and wherein the tubular shroud is disposed about the body such that the radially innermost surface and the manifold channel form a manifold fluidly coupled between the plurality of inlet channels and the outlet channel.

8. A production system for a subterranean wellbore, the system comprising:

a production string disposed within the wellbore, wherein the production string has a central axis and includes an axially extending internal throughbore;

a plurality of screens disposed along the production string, wherein an annulus is formed between the production string and the wellbore that is in fluid communication with the internal throughbore via the plurality of screens; and a bypass device coupled to the production string, wherein the bypass device comprises an inlet assembly and a shunt tube coupled to the inlet assembly, wherein the shunt tube is in fluid communication with the annulus;

wherein the inlet assembly comprises:

a first body member disposed about the production string;

a second body disposed about the production string, wherein the second body member is downhole of and axially spaced from the first body member;

a shroud disposed circumferentially about the first body member and the second body member;

at least one inlet flow path within the first body member that is fluidly coupled to the annulus, wherein the first body member does not extend a full 360° about the central axis, and wherein the at least one inlet flow path is defined radially between the shroud and the production string, circumferentially adjacent to the first body member;

a manifold axially disposed between the first body member and the second body member and fluidly coupled to the at least one inlet flow path; and an outlet flow path fluidly coupled to the shunt tube and the manifold.

9. The production system of claim 8, wherein the manifold is defined axially between the first body member and the second body member, and radially between the production string and the shroud.

10. The production system of claim 9, wherein the manifold circumferentially surrounds the production string axially between the first body member and the second body member.

11. The production system of claim 8, wherein the first body member is pivotable about the central axis relative to the shroud and the production string.

12. The production system of claim 8, wherein the outlet flow path comprises a plurality of outlet flow tubes, wherein the plurality of outlet flow tubes are disposed on a first circumferential side of the production string with respect to the central axis, wherein the first circumferential side covers approximately 180° of the production string.

13. The production system of claim 12, wherein the outlet flow tubes are spaced approximately 20° to approximately 30° apart from one another about the central axis.

14. A production system for a subterranean wellbore, the system comprising:

a production string disposed within the wellbore, wherein the production string has a central axis and includes an axially extending internal throughbore;

a plurality of screens disposed along the production string, wherein an annulus is formed between the production string and the wellbore that is in fluid communication with the internal throughbore via the plurality of screens; and a bypass device coupled to the production string, wherein the bypass device comprises an inlet assembly and a shunt tube coupled to the inlet assembly, wherein the shunt tube is in fluid communication with the annulus;

wherein the inlet assembly comprises:

a first body member disposed about the production string;

a second body disposed about the production string, wherein the second body member is downhole of and axially spaced from the first body member;

a plurality of inlet flow tubes that extend uphole of an uphole end of the first body member that are fluidly coupled to the annulus, wherein the plurality of inlet flow tubes comprises four or more inlet flow tubes that are uniformly-circumferentially spaced about the central axis;

a burst disc within each of the inlet flow tubes;

a manifold axially disposed between the first body member and the second body member and fluidly coupled to the at least one inlet flow path; and an outlet flow path fluidly coupled to the shunt tube and the manifold.

15. A production system for a subterranean wellbore, the system comprising:

a production string disposed within the wellbore, wherein the production string has a central axis and includes an axially extending internal throughbore;

a plurality of screens disposed along the production string, wherein an annulus is formed between the production string and the wellbore that is in fluid communication with the internal throughbore via the plurality of screens; and a bypass device coupled to the production string, wherein the bypass device comprises an inlet assembly and a shunt tube coupled to the inlet assembly, wherein the shunt tube is in fluid communication with the annulus;

wherein the inlet assembly comprises:

a first body member disposed about the production string;

a second body disposed about the production string, wherein the second body member is downhole of and axially spaced from the first body member;

an inlet flow path within the second body member that is fluidly coupled to the annulus;

an outlet flow path within the second body member that is fluid coupled to the annulus and the shunt tube; and a manifold fluidly axially disposed between the first body member and the second body member and fluidly coupled to the inlet flow path and the outlet flow path.

16. The production system of claim 15, wherein the inlet flow path extends from a downhole end of the second body member to the manifold.

17. The production system of claim 16, wherein the inlet assembly comprises a shroud disposed circumferentially about the first body member and the second body member, wherein the manifold is defined axially between the first body member and the second body member, and radially between the production string and the shroud.

* * * * *